US009075326B2

(12) United States Patent
Korenaga et al.

(10) Patent No.: US 9,075,326 B2
(45) Date of Patent: Jul. 7, 2015

(54) ELECTROPHOTOGRAPHIC PHOTORECEPTOR, PROCESS CARTRIDGE, AND IMAGE FORMING APPARATUS

(75) Inventors: Jiro Korenaga, Kanagawa (JP); Keiko Matsuki, Kanagawa (JP); Masahiro Iwasaki, Kanagawa (JP); Mitsuhide Nakamura, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 66 days.

(21) Appl. No.: 13/452,238

(22) Filed: Apr. 20, 2012

(65) Prior Publication Data

US 2013/0101929 A1 Apr. 25, 2013

(30) Foreign Application Priority Data

Oct. 20, 2011 (JP) ..... 2011-230820

(51) Int. Cl.

| | |
|---|---|
| ***G03G 5/00*** | (2006.01) |
| ***G03G 5/04*** | (2006.01) |
| ***G03G 15/00*** | (2006.01) |
| ***G03G 5/05*** | (2006.01) |
| ***G03G 5/06*** | (2006.01) |
| ***G03G 5/07*** | (2006.01) |
| ***G03G 5/147*** | (2006.01) |

(52) U.S. Cl.

CPC ..... *G03G 5/0539* (2013.01); *G03G 5/0592* (2013.01); *G03G 5/0596* (2013.01); *G03G5/0614* (2013.01); *G03G 5/071* (2013.01); *G03G 5/075* (2013.01); *G03G 5/14726* (2013.01); *G03G 5/14786* (2013.01); *G03G 5/14791* (2013.01); *G03G 5/14795* (2013.01); *G03G 2215/00957* (2013.01)

(58) Field of Classification Search

CPC ..... G03G 5/04; G03G 5/0592; G03G 5/0575; G03G 5/14786; G03G 5/14791; G03G 5/14795; G03G 5/039; G03G 5/0596; G03G 5/0614; G03G 5/071; G03G 5/075; G03G 5/147

USPC ..... 430/58.35, 66, 69, 73, 58.75, 58.85; 399/111, 159

See application file for complete search history.

(56) References Cited

U.S. PATENT DOCUMENTS

| | | | | |
|---|---|---|---|---|
| 4,792,507 | A | 12/1988 | Yoshihara et al. | |
| 2002/0119382 | A1 | 8/2002 | Nakata et al. | |
| 2010/0248100 | A1* | 9/2010 | Ezumi | 430/56 |
| 2010/0330472 | A1* | 12/2010 | Nakamura et al. | 430/56 |

FOREIGN PATENT DOCUMENTS

| | | |
|---|---|---|
| JP | A-56-051749 | 5/1981 |
| JP | A-63-221355 | 9/1988 |
| JP | A-05-99737 | 4/1993 |
| JP | A-08-278645 | 10/1996 |
| JP | A-2002-82469 | 3/2002 |
| JP | A-2003-186234 | 7/2003 |
| JP | A-2004-029489 | 1/2004 |
| JP | A-2005-091500 | 4/2005 |

* cited by examiner

*Primary Examiner* — Thorl Chea
(74) *Attorney, Agent, or Firm* — Oliff PLC

(57) ABSTRACT

Provided is an electrophotographic photoreceptor including a conductive substrate and a photosensitive layer provided on the conductive substrate, wherein an uppermost surface layer thereof is constituted with a cured film of a composition that contains at least two kinds of reactive charge transporting materials selected from a first reactive charge transporting material having an —OH group as a reactive functional group and a second reactive charge transporting material having an —$OCH_3$ group as a reactive functional group, fluororesin particles, and an alkyl fluoride group-containing copolymer having repeating units represented by the following Structural Formulae A and B, and a relative dielectric constant ∈r of the uppermost surface layer satisfies the following Formula (1):

Formula (1): $3.5 \leq \varepsilon r \leq 4.0$
Structural Formula A
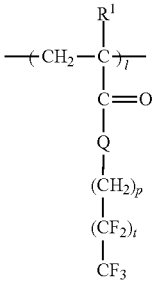
Structural Formula B
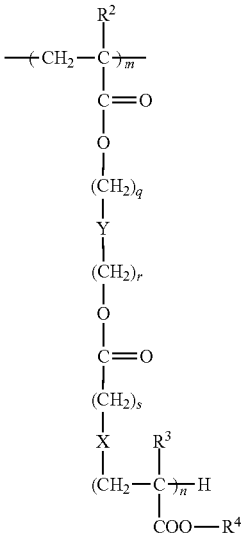
12 Claims, 5 Drawing Sheets

ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2011-230820 filed Oct. 20, 2011.

BACKGROUND

1. Technical Field

The present invention relates to an electrophotographic photoreceptor, a process cartridge, and an image forming apparatus.

2. Related Art

In recent years, in an electrophotographic photoreceptor, a resin having high mechanical strength is used to further extend the life of the electrophotographic photoreceptor.

SUMMARY

According to an aspect of the invention, there is provided an electrophotographic photoreceptor including a conductive substrate and a photosensitive layer provided on the conductive substrate, wherein an uppermost surface layer thereof is constituted with a cured film of a composition that contains at least two kinds of reactive charge transporting materials selected from a first reactive charge transporting material having an —OH group as a reactive functional group and a second reactive charge transporting material having an —$OCH_3$ group as a reactive functional group, fluororesin particles, and an alkyl fluoride group-containing copolymer having repeating units represented by the following Structural. Formulae A and B, and a relative dielectric constant ∈r of the uppermost surface layer satisfies the following Formula (1):

Formula (1): $3.5 \leq \varepsilon r \leq 4.0$

Structural Formula A

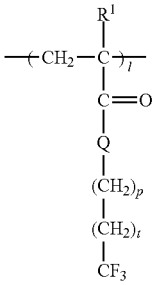

-continued

Structural Formula B

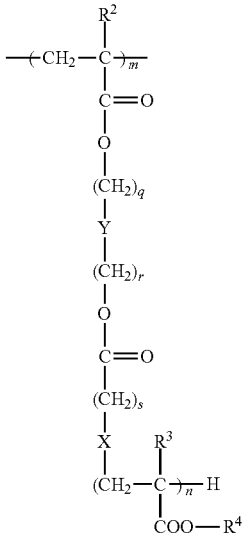

wherein in Structural Formulae A and B, each of $R^1$, $R^2$, $R^3$, and $R^4$ independently represents a hydrogen atom or an alkyl group; X represents an alkylene chain, a halogen-substituted alkylene chain, —S—, —O—, —NH—, or a single bond; Y represents an alkylene chain, a halogen-substituted alkylene chain, —($C_zH_{2z-1}$(OH))—, or a single bond; Q represents —O— or —NH—; each of l, m, and n independently represents an integer of 1 or greater; each of p, q, r, and s independently represents 0 or an integer of 1 or greater; t represents an integer of from 1 to 7; and z represents an integer of 1 or greater.

BRIEF DESCRIPTION OF THE DRAWINGS

Exemplary embodiments of the present invention will be described in detail based on the following figures, wherein.

DETAILED DESCRIPTION

Figure 1:
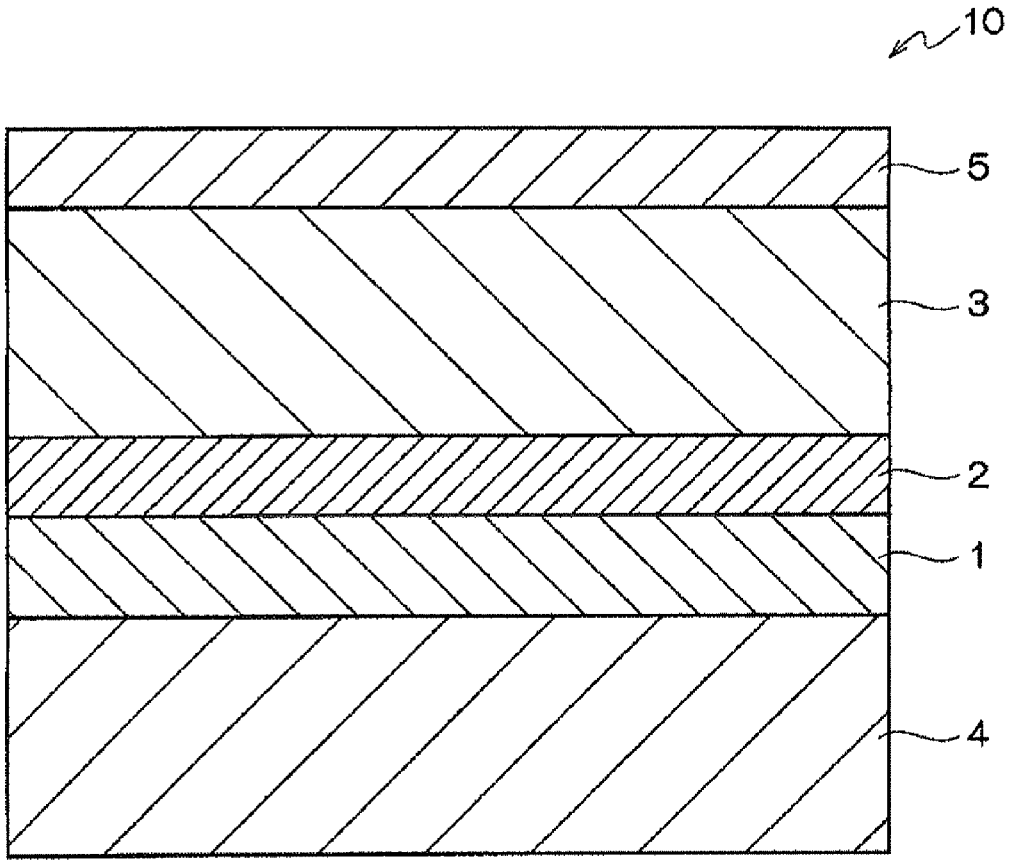
FIG. 1 is a schematic partial cross-sectional view showing an electrophotographic photoreceptor according to the present exemplary embodiment.

An exemplary embodiment of the present invention will be described below.

[Electrophotographic Photoreceptor]

The electrophotographic photoreceptor according to the present exemplary embodiment includes a conductive substrate and a photosensitive layer provided on the conductive substrate.

The uppermost surface layer of the electrophotographic photoreceptor according to the present exemplary embodiment is constituted with a cured film of a composition that contains at least two kinds of reactive charge transporting materials selected from a first reactive charge transporting material having an —OH group as a reactive functional group and a second reactive charge transporting material having an —$OCH_3$ group as a reactive functional group, fluororesin particles, and an alkyl fluoride group-containing copolymer having repeating units represented by the above Structural Formulae A and B, and a relative dielectric constant ∈r of the uppermost surface layer satisfies the following Formula (1):

$$3.5 \leq \in r \leq 4.0 \qquad \text{Formula (1):}$$

Hitherto, it has been known that fluororesin particles are contained in the uppermost surface layer of an electrophotographic photoreceptor. Moreover, in addition to the fluororesin particles, an alkyl fluoride group-containing copolymer as a dispersant that is used to improve the dispersibility of the fluororesin particles is also contained in the uppermost surface layer.

However, it is considered that if contained in the uppermost surface layer, the alkyl fluoride group-containing copolymer is easily polarized when the electrophotographic photoreceptor is charged. Accordingly, the internal electric field of the uppermost surface layer is decreased due to the polarization, and the residual potential tends to be increased.

The residual potential is reduced by decreasing a relative dielectric constant ∈r (for example, decreasing the relative dielectric constant ∈r to 4.0 or less) of the uppermost surface layer. It is considered that this is because a low relative dielectric constant reduces polarizing components in the uppermost surface layer, so the decrease in the internal electric field of the uppermost surface layer is inhibited.

On the other hand, if the relative dielectric constant ∈r of the uppermost surface layer is reduced too much, a surface potential difference between an image portion and a non-image portion increases when images are repeatedly formed, which causes a ghost phenomenon (hereinafter, referred to as a printed ghost in some cases) in which uneven density is formed due to the surface potential difference. It is considered that this is because though the printed ghost is caused due to the difference in the amount of carrier traps between an exposed portion and an unexposed portion, when the relative dielectric constant is small, the surface potential difference between the exposed portion and an unexposed portion increases even with the same difference in the amount of carrier traps.

Therefore, in the electrophotographic photoreceptor according to the present exemplary embodiment, the relative dielectric constant ∈r of the uppermost surface layer which is constituted with a cured film of a composition that contains reactive charge transporting materials, fluororesin particles, and an alkyl fluoride group-containing copolymer having repeating units represented by the following Structural Formulae A and B is adjusted to a high value so as to satisfy the above Formula (1): 3.5≤∈r≤4.0. In addition, in order to adjust the relative dielectric constant ∈r of the uppermost surface layer to a high value in the above range, at least two kinds of materials including the first reactive charge transporting material having an —OH group as a reactive functional group and the second reactive charge transporting material having an —$OCH_3$ group as a reactive functional group are concurrently used as the reactive charge transporting materials.

Structural Formula A

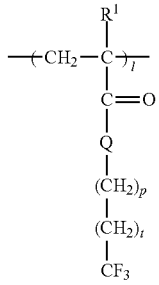

Structural Formula B

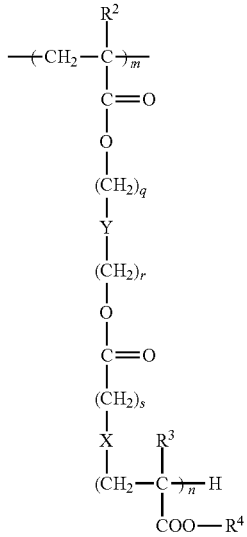

Consequently, in the electrophotographic photoreceptor according to the present exemplary embodiment, the increase in residual potential is inhibited, and the increase in the surface potential difference between an image portion and a non-image portion that is caused when images are repeatedly formed is also inhibited.

In addition, when an image forming apparatus (process cartridge) includes the electrophotographic photoreceptor according to the present exemplary embodiment, images are obtained in which image defects (for example, black spots or fogging) caused by the increase in residual potential and image defects (for example, printed ghost) caused by the increase in surface potential difference between an image portion and a non-image portion that is caused when images are repeatedly formed are inhibited.

Hereinafter, the electrophotographic photoreceptor according to the present exemplary embodiment will be described in detail with reference to drawings.

Figure 2:
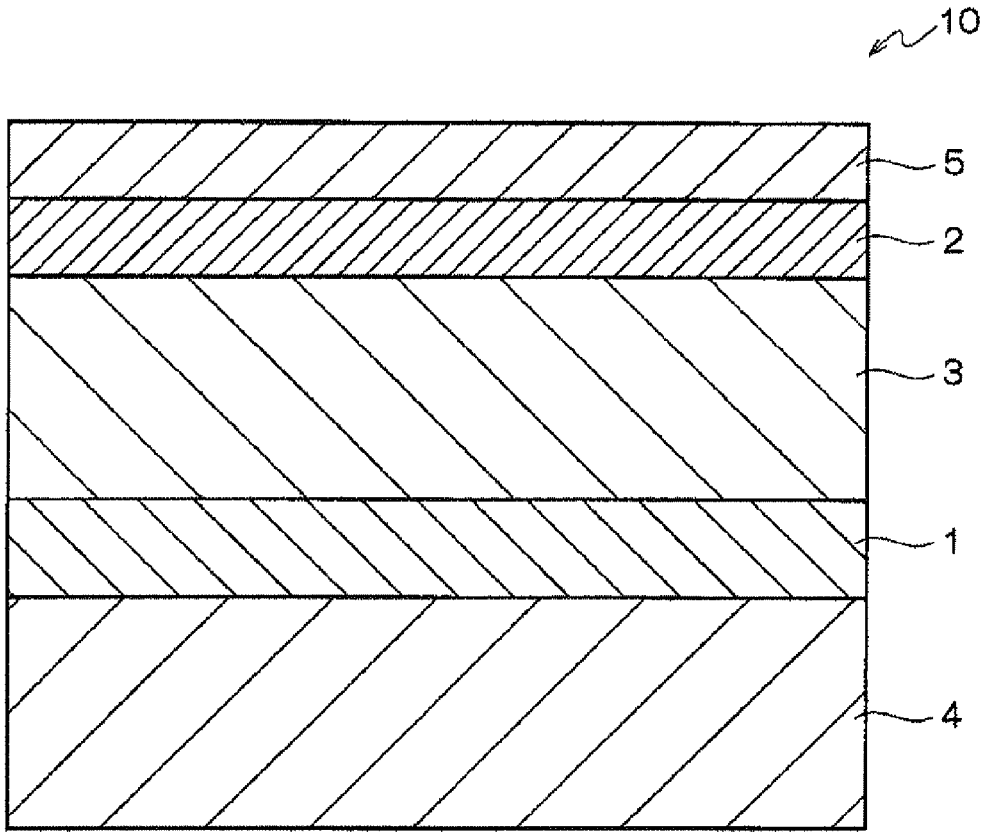
FIG. 2 is a schematic partial cross-sectional view showing another electrophotographic photoreceptor according to the present exemplary embodiment.
Figure 3:
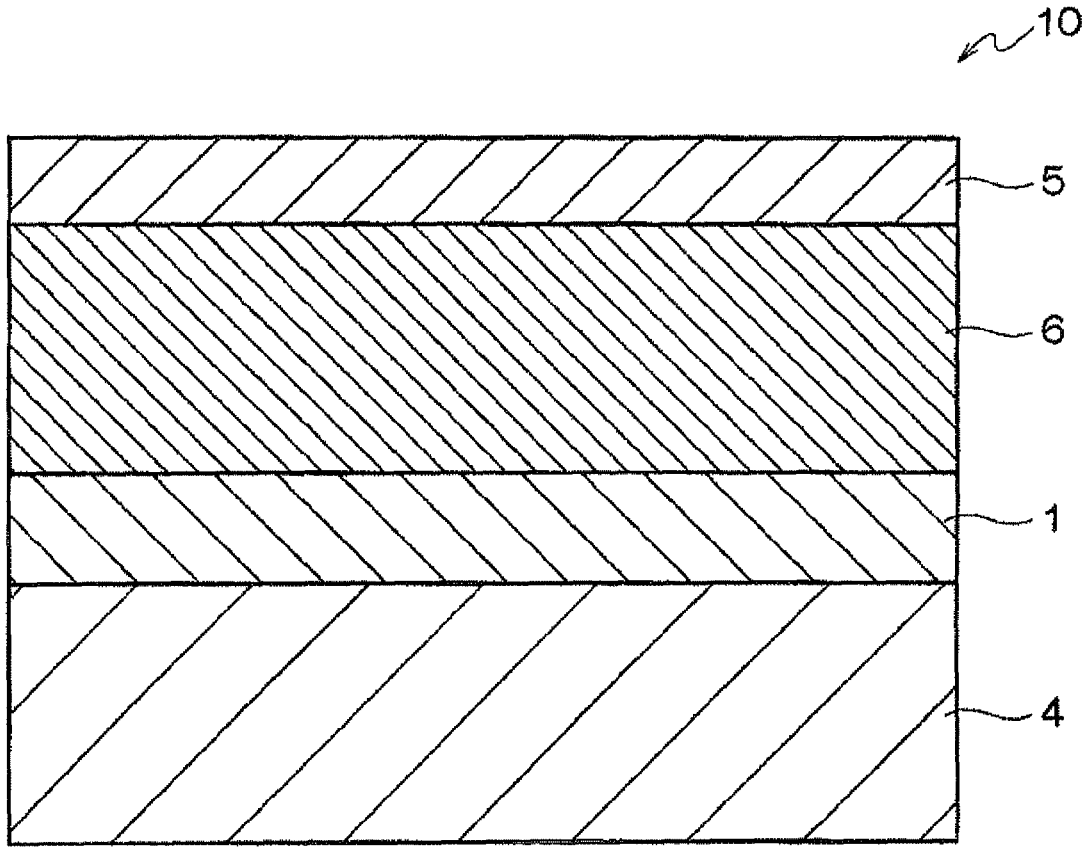
FIG. 3 is a schematic partial cross-sectional view showing another electrophotographic photoreceptor according to the present exemplary embodiment.

Each of FIGS. 1 to 3 schematically shows the cross-section of a portion of an electrophotographic photoreceptor 10 according to the present exemplary embodiment.

In the electrophotographic photoreceptor 10 shown in FIG. 1, an undercoat layer 1 is provided on a conductive supporter 4, a charge generating layer 2 and a charge transporting layer 3 as a photosensitive layer are provided on the undercoat layer, and a surface protective layer 5 is provided as an uppermost surface layer.

The electrophotographic photoreceptor 10 shown in FIG. 2 includes a photosensitive layer that is functionally divided into the charge generating layer 2 and the charge transporting layer 3 just as the electrophotographic photoreceptor 10 shown in FIG. 1. However, in the electrophotographic photoreceptor 10 shown in FIG. 2, the charge transporting layer 3, the charge generating layer 2, and the surface protective layer 5 are provided on the undercoat layer 1 in this order.

The electrophotographic photoreceptor 10 shown in FIG. 3 contains a charge generating material and a charge transporting material in the same layer, that is, in a single layer type photosensitive layer 6 (charge generating and transporting layer), and the surface protective layer 5 is provided on the photosensitive layer 6.

In the electrophotographic photoreceptor 10 shown in FIGS. 1 to 3, the surface protective layer 5 is provided on the photosensitive layer, and this surface protective layer 5 is used as an uppermost surface layer. However, when the surface protective layer 5 is not provided, the uppermost layer of the photosensitive layer becomes the uppermost surface layer. Specifically, when the layer constitution of the electrophotographic photoreceptor 10 shown in FIG. 1 is employed without providing the surface protective layer 5, the charge transporting layer 3 corresponds to the uppermost surface layer. Moreover, when the layer constitution of the electrophotographic photoreceptor 10 shown in FIG. 3 is employed without providing the surface protective layer 5, the single layer type photosensitive layer 6 corresponds to the uppermost surface layer.

Hereinafter, the respective elements will be described based on the electrophotographic photoreceptor 10 that is shown in the drawing as a representative example. In the description, the reference numerals will be omitted.

(Conductive Substrate)

Any material may be used as the conductive substrate so long as the material has been used in the related art Examples of the material include paper, plastic film, or the like coated or impregnated with a conductivity-imparting agent, such as a plastic film provided with a thin film (for example, metals such as aluminum, nickel, chromium, and stainless steel; and a film of aluminum, titanium, nickel, chromium, stainless steel, gold, vanadium, tin oxide, indium oxide, indium tin oxide (ITO), or the like). The shape of the substrate is not limited to a cylindrical shape, and the substrate may have a sheet shape or plate shape.

When a metal pipe is used as the conductive substrate, the surface of the pipe may remain as it is or may be treated in advance with mirror surface cutting, etching, anodization, rough cutting, centerless grinding, sand blasting, wet honing, or the like.

(Undercoat Layer)

The undercoat layer is provided optionally, for the purposes of preventing light reflection in the surface of the conductive substrate, preventing unnecessary inflow of a carrier to the photosensitive layer from the conductive substrate, and the like.

The undercoat layer is constituted with, for example, a binder resin and optionally other additives.

Examples of the binder resin contained in the undercoat layer include known polymeric resin compounds such as an acetal resin including polyvinyl butyral, a polyvinyl alcohol resin, casein, a polyamide resin, a cellulose resin, gelatin, a polyurethane resin, a polyester resin, a methacrylic resin, an acrylic resin, a polyvinyl chloride resin, a polyvinyl acetate resin, a vinyl chloride-vinyl acetate-maleic anhydride resin, a silicone resin, a silicone-alkyd resin, a phenol resin, a phenol-formaldehyde resin, a melamine resin, and a urethane resin, a charge transporting resin having a charge transporting group, a conductive resin such as polyaniline, and the like. Among these, a resin insoluble in a coating solvent of the upper layer is desirably used, and particularly, a phenol resin, a phenol-formaldehyde resin, a melamine resin, a urethane resin, an epoxy resin, and the like are desirably used.

The undercoat layer may contain a metal compound such as a silicon compound, an organic zirconium compound, an organic titanium compound, an organic aluminum compound, or the like.

The ratio between the metal compound and the binder resin is not particularly limited and may be arbitrarily set within a range in which desired characteristics of the electrophotographic photoreceptor are obtained.

In order to adjust the surface roughness, resin particles may be added to the undercoat layer. Examples of the resin particles include silicone resin particles, crosslinked polymethyl methacrylate (FNMA) resin particles, and the like. In addition, to adjust the surface roughness, the surface of the formed undercoat layer may be polished. As the polishing method, buffing, sand blasting, wet honing, grinding, and the like are used.

Herein, examples of the constitution of the undercoat layer include a constitution that contains at least a binder resin and conductive particles. The conductive particles desirably have conductivity in which volume resistivity is, for example, less than $10^7$ Ω·cm.

Examples of the conductive particles include metal particles (particles of aluminum, copper, nickel, silver, or the like), conductive metallic oxide particles (particles of antimony oxide, indium oxide, tin oxide, zinc oxide, or the like), and conductive material particles (particles of carbon fiber, carbon black, graphite powder, or the like). Among these, conductive metallic oxide particles are suitable. The conductive particles may be used as a mixture of two or more kinds thereof.

The conductive particles may be surface-treated using a hydrophobizing agent (for example, a coupling agent) to adjust resistance before using the particles.

The amount of the conductive particles contained in the undercoat layer is, for example, desirably from 10% by weight to 80% by weight, and more desirably from 40% by weight to 80% by weight, based on the binder resin.

For the formation of the undercoat layer, a coating liquid for forming an undercoat layer obtained by adding the above components to a solvent is used.

As methods of dispersing the particles in the coating liquid for forming an undercoat layer, a media dispersing machine such as a ball mill, a vibration ball mill, an attritor, a sand mill, or a horizontal sand mill; stirring; and a media-less dispersing machine such as an ultrasonic dispersing machine, a roll mill, or a high pressure homogenizer are used. Herein, examples of the high pressure homogenizer include a collision type which disperses a dispersion through liquid-to-liquid collision or liquid-to-wall collision in a high pressure state, a penetration type which disperses the dispersion by causing the dispersion to penetrate a fine flow path in a high pressure state, and the like.

Examples of a method of coating the coating liquid for forming an undercoat layer onto the conductive substrate include dip-coating, push-up coating, wire bar coating, spray coating, blade coating, knife coating, curtain coating, and the like.

The film thickness of the undercoat layer is desirably 15 μm or more, and more desirably from 20 μm to 50 μm.

Though not shown in the drawing, an interlayer may be provided between the undercoat layer and the photosensitive layer. Examples of the binder resin used for the interlayer include polymeric resin compounds such as an acetal resin including polyvinyl butyral, a polyvinyl alcohol resin, casein, a polyamide resin, a cellulose resin, gelatin, a polyurethane resin, a polyester resin, a methacrylic resin, an acrylic resin, a polyvinyl chloride resin, a polyvinyl acetate resin, a vinyl chloride-vinyl acetate-maleic anhydride resin, a silicone resin, a silicone-alkyd resin, a phenol-formaldehyde resin, a melamine resin, and organometallic compounds containing zirconium, titanium, aluminum, manganese, silicon atoms, and the like. These compounds may be used alone, or may be used as a mixture of plural compounds or as a polycondensate. Among these, an organometallic compound containing zirconium or silicon is suitable in respects that residual potential is low, and that potential change caused by environments and repeated use is small in this compound.

For the formation of the interlayer, a coating liquid for forming an interlayer obtained by adding the above components to a solvent is used.

As a coating method for forming the interlayer, general methods such as dip-coating, push-up coating, wire bar coating, spray coating, blade coating, knife coating, and curtain coating are used.

The interlayer not only plays a role of improving a coating property of the upper layer, but also plays a role of an electrical blocking layer. However, when the film thickness of the interlayer is too large, an electrical barrier becomes too strong, which leads to desensitization or potential increase caused by repeated use in some cases. Accordingly, when the interlayer is formed, the film thickness thereof is desirably set in a range of from 0.1 μm to 3 μm. In addition, the interlayer in this case may be used as an undercoat layer.

(Charge Generating Layer)

The charge generating layer is constituted with, for example, a charge generating material and a binder resin. Examples of the charge generating material include phthalocyanine pigments such as metal-free phthalocyanine, chlorogallium phthalocyanine, hydroxygallium phthalocyanine, dichlorotin phthalocyanine, and titanyl phthalocyanine. The examples particularly include chlorogallium phthalocyanine crystals having strong diffraction peaks at Bragg angles (2θ±0.2°) of at least 7.4°, 16.6°, 25.5°, and 28.3° with respect to X-rays having CuKα characteristics, metal-free phthalocyanine crystals having strong diffraction peaks at Bragg angles (2θ±0.2°) of at least 7.7°, 9.3°, 16.9°, 17.5°, 22.4°, and 28.8° with respect to X-rays having CuKα characteristics, hydroxygallium phthalocyanine crystals having strong diffraction peaks at Bragg angles (2θ±0.2°) of at least 7.5°, 9.9°, 12.5°, 16.3°, 18.6°, 25.1°, and 28.3° with respect to X-rays having CuKα characteristics, and titanyl phthalocyanine crystals having strong diffraction peaks at Bragg angles (2θ±0.2°) of at least 9.6°, 24.1°, and 27.2° with respect to X-rays having CuKα characteristics. Examples of the charge generating material also include a quinone pigment, a perylene pigment, an indigo pigment, a bisbenzimidazole pigment, an anthrone pigment, a quinacridone pigment, and the like. These charge generating materials may be used alone or used as a mixture of two or more kinds thereof.

Examples of the binder resin constituting the charge generating layer include a bisphenol A type or bisphenol Z type polycarbonate resin, an acrylic resin, a methacrylic resin, a polyarylate resin, a polyester resin, a polyvinyl chloride resin, a polystyrene resin, an acrylonitrile-styrene copolymer resin, an acrylonitrile-butadiene copolymer, a polyvinyl acetate resin, a polyvinyl formal resin, a polysulfone resin, a styrene-butadiene copolymer resin, a vinylidene chloride-acrylonitrile copolymer resin, a vinyl chloride-vinyl acetate-maleic anhydride resin, a silicone resin, a phenol-formaldehyde resin, a polyacrylamide resin, a polyimide resin, a poly-N-vinylcarbazole resin, and the like. These binder resins may be used alone or used as a mixture of two or more kinds thereof.

The mixing ratio between the charge generating material and the binder resin is desirably in a range of from 10:1 to 1:10, for example.

For the formation of the charge generating layer, a coating liquid for forming a charge generating layer obtained by adding the above components to a solvent is used.

As a method of dispersing particles (for example, the charge generating material) in the coating liquid for forming a charge generating layer, a media dispersing machine such as a ball mill, a vibration ball mill, an attritor, a sand mill, or a horizontal sand mill; stirring; and a media-less dispersing machine such as an ultrasonic dispersing machine, a roll mill, or a high pressure homogenizer are used. Examples of the high pressure homogenizer include a collision type which disperses a dispersion through liquid-to-liquid collision or liquid-to-wall collision in a high pressure state, a penetration type which disperses the dispersion by causing the dispersion to penetrate a fine flow path in a high pressure state, and the like.

Examples of a method of coating the coating liquid for forming a charge generating layer onto the undercoat layer include dip-coating, push-up coating, wire bar coating, spray coating, blade coating, knife coating, curtain coating, and the like.

The film thickness of the charge generating layer is set desirably in a range of from 0.01 μm to 5 μm, and more desirably in a range of from 0.05 μm to 2.0 μm.

(Charge Transporting Layer)

The charge transporting layer is constituted with a charge transporting material and optionally a binder resin. When the charge transporting layer corresponds to the uppermost surface layer, the charge transporting layer contains the fluororesin particles having the above specific surface area as described above.

Examples of the charge transporting material include an oxadiazole derivative such as 2,5-bis(p-diethylaminophenyl)-1,3,4-oxadiazole; a pyrazoline derivative such as 1,3,5-triphenyl-pyrazoline or 1-[pyridyl-(2)]-3-(p-diethylaminostyryl)-5-(p-diethylaminostyryl)pyrazoline; an aromatic tertiary amino compound such as triphenylamine, N,N'-bis(3,4-dimethylphenyl)biphenyl-4-amine, tri(p-methylphenyl)aminyl-4-amine, or dibenzylaniline; an aromatic tertiary diamino compound such as N,N'-bis(3-methylphenyl)-N,N'-diphenylbenzidine; a 1,2,4-triazine derivative such as 3-(4'-dimethylaminophenyl)-5,6-di-(4'-methoxyphenyl)-1,2,4-triazine; a hydrazone derivative such as 4-diethylaminobenzaldehyde-1,1-diphenylhydrazone; a quinazoline derivative such as 2-phenyl-4-styryl-quinazoline; a benzofuran derivative such as 6-hydroxy-2,3-di(p-methoxyphenyl)benzofuran; an α-stilbene derivative such as p-(2,2-diphenylvinyl)-N,N-diphenyl aniline; an enamine derivative; a carbazole derivative such as N-ethylcarbazole; hole transport materials such as poly-N-vinylcarbazole and a derivative thereof; a quinone-based compound such as chloranil or bromoanthraquinone; a tetracyanoquinodimethane-based compound; a fluorenone compound such as 2,4,7-trinitrofluorenone or 2,4,5,7-tetranitro-9-fluorenone; a xanthone-based compound; and an electron transport material such as a thiophene compound; and a polymer having a group including the above compounds in a main chain or a side chain thereof. These charge transporting materials may be used alone or in combination of two or more kinds thereof.

Examples of the binder resin constituting the charge transporting layer include bisphenol A type or bisphenol Z type polycarbonate resin, an acrylic resin, a methacrylic resin, a polyarylate resin, a polyester resin, a polyvinyl chloride resin, a polystyrene resin, an acrylonitrile-styrene copolymer resin, an acrylonitrile-butadiene copolymer resin, a polyvinyl acetate resin, a polyvinyl formal resin, a polysulfone resin, a styrene-butadiene copolymer resin, a vinylidene chloride-acrylonitrile copolymer resin, a vinyl chloride-vinyl acetate-maleic anhydride resin, a silicone resin, a phenol-formaldehyde resin, a polyacrylamide resin, a polyamide resin, an insulating resin such as chlorinated rubber, an organic photoconductive polymer such as polyvinyl carbazole, polyvinyl anthracene, or polyvinyl pyrene, and the like. These binder resins may be used alone or used as a mixture of two or more kinds thereof.

The mixing ratio between the charge transporting material and the binder resin is desirably from 10:1 to 1:5, for example.

The charge transporting layer is formed using a coating liquid for forming the charge transporting layer obtained by adding the above components to a solvent.

As a method of dispersing particles (for example, the fluororesin particles) in the coating liquid for forming a charge transporting layer, a media dispersing machine such as a ball mill, a vibration ball mill, an attritor, a sand mill, or a horizontal sand mill; stirring; and a media-less dispersing machine such as an ultrasonic dispersing machine, a roll mill, or a high pressure homogenizer are used. Examples of the high pressure homogenizer include a collision type which disperses a dispersion through liquid-to-liquid collision or liquid-to-wall collision in a high pressure state, a penetration type which disperses the dispersion by causing the dispersion to penetrate a fine flow path in a high pressure state, and the like.

As a method of coating the coating liquid for forming the charge transporting layer onto the charge generating layer, a general method such as dip-coating, push-up coating, wire bar coating, spray coating, blade coating, knife coating, or curtain coating is used.

The film thickness of the charge transporting layer is set desirably to a range of from 5 μm to 50 μm, and more desirably to a range of from 10 μm to 40 μm.

(Surface Protective Layer)

First, the characteristics of the surface protective layer will be described.

The relative dielectric constant ∈r of the surface protective layer satisfies the following Formula (1) (satisfies desirably the following Formula (1-2) and more desirably the following Formula (1-3)).

$$3.5 \leq \in r \leq 4.0 \quad \text{Formula (1):}$$

$$3.6 \leq \in r \leq 4.0 \quad \text{Formula (1-2):}$$

$$3.6 \leq \in r \leq 3.9 \quad \text{Formula (1-3):}$$

If the relative dielectric constant ∈r of the surface protective layer is 3.5 or greater, the printed ghost is inhibited.

On the other hand, if the relative dielectric constant ∈r of the surface protective layer is 4.0 or less, the increase in residual voltage is inhibited.

The relative dielectric constant ∈r of the surface protective layer is adjusted by concurrently using at least two kinds of reactive charge transporting materials respectively selected from the first reactive charge transporting material having an —OH group as a reactive functional group and the second reactive charge transporting material having an $—OCH_3$ group as a reactive functional group. In addition, the relative dielectric constant ∈r is also adjusted by, for example, 1) adjusting the mixing ratio between at least two kinds of the reactive charge transporting materials,
2) adjusting the amount of a specific antioxidant mixed,
3) adjusting the amount of a curing catalyst mixed, and the like.

The relative dielectric constant ∈r of the surface protective layer is calculated in the following manner.

A plate-shaped sample is collected from a layer to be measured that is included in the electrophotographic photoreceptor. This plate-shaped sample is then interposed between a gold electrode and an aluminum plate, thereby preparing a sandwich cell. By using an impedance analyzer manufactured by SOLARTRON Analytical, applied AC resistance and capacitance of the sandwich cell are measured, and a relative dielectric constant WP is calculated. The measurement conditions are as follows.

Frequency band of measurement: 1000000 Hz to 0.001 Hz
Bias voltage: 0 V
Applied peak AC electric field: 0.2 V/μm
Measurement environment: 30° C., 85% RH A charge amount Q [$C/mm^2$] of carrier traps of the surface protective layer satisfies desirably the following Formula (2) (more desirably the following Formula (2-2), and even more desirably the following Formula (2-3)).

$$Q \leq 5.0 \times 10^{-8} \quad \text{Formula (2):}$$

$$Q \leq 4.0 \times 10^{-8} \quad \text{Formula (2-2):}$$

$$Q \leq 3.0 \times 10^{-8} \quad \text{Formula (2-3):}$$

If the charge amount Q of carrier traps of the surface protective layer is in the above range, the increase in residual potential is easily inhibited. It is considered that this is because if the carrier traps remain in the surface protective layer, residual potential is exhibited in the electrophotographic photoreceptor.

The charge amount Q of carrier traps of the surface protective layer is adjusted by, for example, 1) adjusting the amount of a melamine compound or a guanamine compound, 2) adjusting the amount of an alkyl fluoride group-containing copolymer, 3) adjusting the amount of an antioxidant contained in the surface protective layer, and the like.

The charge amount Q of carrier traps of the surface protective layer is calculated in the following manner.

A plate-shaped sample is collected from a layer to be measured that is included in the electrophotographic photoreceptor. This plate-shaped sample is then interposed between a gold electrode and an aluminum plate, thereby preparing a sandwich cell. By using a TS-FETT manufactured by Rigaku Corporation., the value of current escaping due to traps is measured with respect to the sandwich cell, thereby calculating the charge amount Q of carrier traps. The measurement conditions are as follows.

Temperature sweep range: −150° C. to 100° C.
Wavelength of irradiated light: 380 nm
Intensity of irradiated light: 370 $\mu W/cm^2$
Correct voltage: 1 V
Rate of temperature increase: 10° C./min A volume resistivity ρ [Ω·m] of the surface protective layer satisfies desirably the following Formula. (3) (more desirably the following Formula (3-2), and even more desirably the following Formula (3-3)).

$$1.0 \times 10^{11} \leq \rho \leq 2.0 \times 10^{12} \quad \text{Formula (3):}$$

$$1.3 \times 10^{11} \leq \rho \leq 2.0 \times 10^{12} \quad \text{Formula (3-2):}$$

$$1.3 \times 10^{11} \leq \rho \leq 1.9 \times 10^{12} \quad \text{Formula (3-3):}$$

If the volume resistivity p of the surface protective layer is in the above range, the increase in residual potential is inhibited, and the printed ghost is easily suppressed. It is considered that this is because the low volume resistivity makes it difficult for the carriers to remain in the surface protective layer.

The volume resistivity p of the surface protective layer is adjusted by, for example, adjusting the amount of a curing catalyst in the surface protective layer, and the like.

The volume resistivity p of the surface protective layer is calculated in the following manner.

A plate-shaped sample is collected from a layer to be measured that is included in the electrophotographic photoreceptor. This plate-shaped sample is then interposed between a gold electrode and an aluminum plate, thereby preparing a sandwich cell. By using an impedance analyzer manufactured by SOLARTRON Analytical, applied AC resistance and capacitance of the sandwich cell are measured, thereby calculating the volume resistivity. The measurement conditions are as follows.

Frequency band of measurement: 1000000 Hz to 0.001 Hz

Bias voltage: 0 V

Applied peak AC electric field: 0.2 V/μm

Measurement environment: 30° C., 85% RH

An ionization potential IP(OCL) [eV] of the surface protective layer satisfies desirably the following Formula (4) (more desirably the following Formula (4-2), and even more desirably the following Formula (4-3)).

In the following Formula (4), IP(CTL) represents an ionization potential [eV] of the charge transporting layer (or the single layer type photosensitive layer).

$$IP(OCL)-IP(CTL)\leq 1.0 \quad \text{Formula (4):}$$

$$IP(OCL)-IP(CTL)\leq 0.5 \quad \text{Formula (4-2):}$$

$$IP(OCL)-IP(CTL)\leq 0.2 \quad \text{Formula (4-3):}$$

If the above relationship is established between the ionization potential IP(OCL) of the surface protective layer and the ionization potential IP(CTL) of the charge transporting layer (or single layer type photosensitive layer), the increase in residual potential is easily inhibited. It is considered that this is because the efficiency of injecting carriers in the surface protective layer from the charge transporting layer is improved.

The ionization potential of the surface protective layer and the charge transporting layer (or the single layer type photosensitive layer) is adjusted by, for example, 1) selecting the type of the charge transporting material,
2) adjusting the amount of the charge transporting material mixed, and the like.

The ionization potential of the surface protective layer and the charge transporting layer (or single layer type photosensitive layer) is calculated in the following manner.

A plate-shaped sample is collected from a layer to be measured that is included in the electrophotographic photoreceptor. This plate-shaped sample is then interposed between a gold electrode and an aluminum plate, thereby preparing a sandwich cell. By using AC-2 manufactured by RIKEN, the ionization potential of the sandwich cell is measured.

Next, the constitution of the surface protective layer will be described.

The surface protective layer is constituted with a cured film of a composition that contains reactive charge transporting materials, fluororesin particles, and an alkyl fluoride group-containing copolymer. That is, the surface protective layer is constituted with a charge transporting cured film that contains a polymer (or a crosslinked substance) of reactive charge transporting materials, fluororesin particles, and an alkyl fluoride group-containing copolymer.

From the viewpoints of improving the mechanical strength and extending the life of the electrophotographic photoreceptor, the surface protective layer may be constituted with a cured film of a composition that further contains at least one kind selected from a guanamine compound and a melamine compound. That is, the surface protective layer may be constituted with a charge transporting cured film that contains a polymer (crosslinked substance) of reactive charge transporting materials and at least one kind selected from a guanamine compound and a melamine compound, fluororesin particles, and an alkyl fluoride group-containing copolymer.

The surface protective layer may be constituted with a cured film of a composition that further contains a specific antioxidant, from the viewpoint of inhibiting the increase in residual potential by adjusting the relative dielectric constant to the range satisfying the above Formula (1) and from the viewpoint of inhibiting the increase in the surface potential difference between an image portion and a non-image portion that is caused when images are repeatedly formed. That is, the surface protective layer may be constituted with a charge transporting cured film that contains a polymer (or a crosslinked substance) of reactive charge transporting materials, fluororesin particles, an alkyl fluoride group-containing copolymer, and a specific antioxidant.

The reactive charge transporting materials will be described.

As the reactive charge transporting materials, at least two kinds selected respectively from the first reactive charge transporting material having an —OH group as a reactive functional group and a second reactive charge transporting material having an $—OCH_3$ group as a reactive functional group are employed.

In addition, a reactive charge transporting material other than these two kinds of the first and second reactive charge transporting materials may be used concurrently.

The reactive charge transporting material is a reactive charge transporting material having a reactive functional group. A reactive charge transporting material having an —OH group as a reactive functional group is the first reactive charge transporting material, a reactive charge transporting material having an $—OCH_3$ group as a reactive functional group is the second reactive charge transporting material, and a reactive charge transporting material having a reactive functional group (for example, $—NH_2$, —SH, —COOH, or the like) other than the —OH group and the $—OCH_3$ group as a reactive functional group is the other reactive charge transporting material.

Hereinafter, these reactive charge transporting materials are simply referred to as a "reactive charge transporting material" in general for the description.

The reactive charge transporting material is desirably a charge transporting material having at least two (desirably three) reactive substituents. If the number of the reactive functional groups in the charge transporting material increases in this manner, crosslink density is improved, and a stronger cured film (crosslinked film) is obtained. Particularly, rotation torque of the electrophotographic photoreceptor at the time of using a foreign substance-removing member such as a blade member is reduced, whereby the abrasion of the foreign substance-removing member or the electrophotographic photoreceptor is inhibited. Though unclear, the reason is presumed to be as below. That is, a cured film with high crosslink density is obtained by increasing the number of the reactive functional groups, and accordingly, molecular movement in the polar surface of the electrophotographic photoreceptor is inhibited, which weakens the interaction between the blade member and the molecules in the surface.

From the viewpoint of inhibiting the abrasion of the foreign substance-removing member or the electrophotographic photoreceptor, the reactive charge transporting material is desirably a compound represented by the following Formula (I).

$$F—((—R^{13}—X)_{n1}(R^{14})_{n2}—Y)_{n3} \quad (I)$$

In Formula (I), F represents an organic group (charge transporting skeleton) derived from a compound with an ability to transport charge, each of $R^{13}$ and $R^{14}$ independently represents a linear or branched alkylene group having from 1 to 5 carbon atoms, n1 represents 0 or 1, n2 represents 0 or 1, and n3 represents an integer of from 1 to 4. X represents oxygen, NH, or a sulfur atom, and Y represents a reactive functional group.

In Formula (I), as the compound with an ability to transport charge, which is the compound from which the organic group represented by F is derived, an arylamine derivative is suitably exemplified. Examples of the arylamine derivative suitably include a triphenylamine derivative and a tetraphenylbenzidine derivative.

The compound represented by Formula (I) is desirably a compound represented by the following Formula (II). The compound represented by Formula (II) is excellent particularly in charge mobility, stability with respect to oxidation, and the like.

(II)

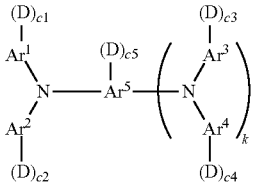

In Formula (II), $Ar^1$ to $Ar^4$ may be the same as or different from each other, and each of $Ar^1$ to $Ar^4$ independently represents a substituted or unsubstituted aryl group. $Ar^5$ represents a substituted or unsubstituted aryl group or a substituted or unsubstituted arylene group, D represents $—(—R^{13}—X)_{n1}(R^{14})_{n2}—Y$. Each of c1 to c5 independently represents 0 or 1, k represents 0 or 1, and the total number of D is from 1 to 4. Each of $R^{13}$ and $R^{14}$ independently represents a linear or branched alkylene group having from 1 to 5 carbon atoms, n1 represents 0 or 1, and n2 represents 0 or 1. X represents oxygen, NH, or a sulfur atom, and Y represents a reactive functional group.

Herein, examples of the substituent in the substituted aryl group and the substituted arylene group include an alkyl group having from 1 to 4 carbon atoms, an alkoxy group having from 1 to 4 carbon atoms, and a substituted or unsubstituted aryl group having from 6 to 10 carbon atoms, other than D.

In Formula (II), "$—(—R^{13}—X)_{n1}(R^{14})_{n2}—Y$" represented by D has the same definition as in Formula (I), and each of $R^{13}$ and $R^{14}$ independently represents a linear or branched alkylene group having from 1 to 5 carbon atoms. In addition, n1 is desirably 1, n2 is desirably 1, and X is desirably oxygen.

The total number of D in Formula (II) corresponds to n3 in Formula (I), and the number is desirably from 2 to 4, and more desirably from 3 to 4.

In Formula (I) or (II), if the total number of D is from 2 to 4 and desirably from 3 to 4 in a molecule, crosslink density is improved, and a stronger crosslinked film is obtained. Particularly, rotation torque of the electrophotographic photoreceptor at the time of using a blade member for removing foreign substances is reduced, whereby the abrasion of the blade member and the electrophotographic photoreceptor is inhibited. Though unclear, the reason is presumed to be the same as described above. That is, a cured film with high crosslink density is obtained by increasing the number of the reactive functional groups, and accordingly, molecular movement in the polar surface of the electrophotographic photoreceptor is inhibited, which weakens the interaction between the blade member and the molecules in the surface.

In Formula (II), $Ar^1$ to $Ar^4$ are desirably any one of the following Formulae (1) to (7). The following Formulae (1) to (7) in common show "$-(D)_c$" (here, c represents any one of c1 to c5) that may be linked to each of $Ar^1$ to $Ar^4$.

(1)

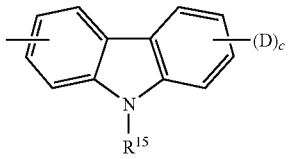

(2)

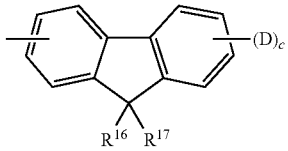

(3)

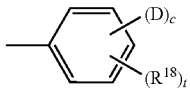

(4)

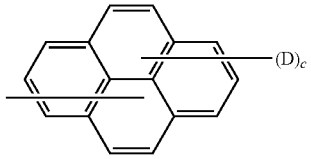

(5)

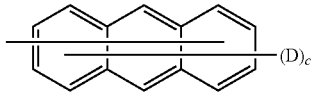

(6)

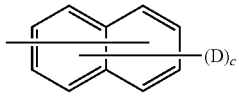

(7)

$—Ar—(Z')_s—Ar—(D)_c$

In Formulae (1) to (7), $R^{15}$ represents one kind selected from a group consisting of a hydrogen atom, an alkyl group having from 1 to 4 carbon atoms, a phenyl group substituted with an alkyl group having from 1 to 4 carbon atoms or with an alkoxy group having from 1 to 4 carbon atoms, an unsubstituted phenyl group, and an aralkyl group having from 7 to 10 carbon atoms. Each of $R^{16}$ to $R^{18}$ represents one kind selected from a group consisting of a hydrogen atom, an alkyl group having from 1 to 4 carbon atoms, an alkoxy group having from 1 to 4 carbon atoms, a phenyl group substituted with an alkoxy group having from 1 to 4 carbon atoms, an unsubstituted phenyl group, an aralkyl group having from 7 to 10 carbon atoms, and a halogen atom. Ar represents a substituted or unsubstituted arylene group, and D and c have the same definition as "D" and "c1 to c5" in Formula (II). Each s represents 0 or 1, and t represents an integer of from 1 to 3.

Herein, Ar in Formula (7) is desirably represented by the following Formula (8) or (9).

(8)

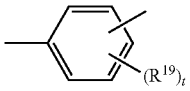

(9)

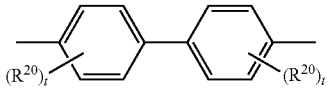

In Formulae (8) and (9), each of $R^{19}$ and $R^{20}$ represents one kind selected from a group consisting of a hydrogen atom, an alkyl group having from 1 to 4 carbon atoms, an alkoxy group having from 1 to 4 carbon atoms, a phenyl group substituted with an alkoxy group having from 1 to 4 carbon atoms, an unsubstituted phenyl group, an aralkyl group having from 7 to 10 carbon atoms, and a halogen atom. t represents an integer of from 1 to 3.

Z' in Formula (7) is desirably represented by any one of the following Formulae (10) to (17).

(10)

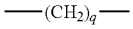

(11)

(12)

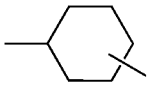

(13)

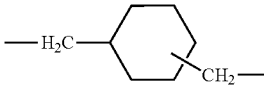

(14)

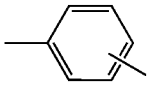

(15)

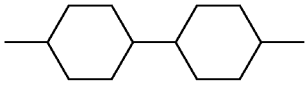

(16)

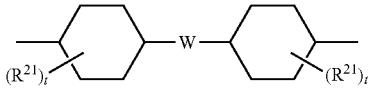

(17)

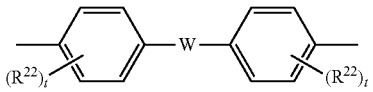

In Formulae (10) to (17), each of $R^{21}$ and $R^{22}$ represents one kind selected from a group consisting of a hydrogen atom, an alkyl group having from 1 to 4 carbon atoms, an alkoxy group having from 1 to 4 carbon atoms, a phenyl group substituted with an alkoxy group having from 1 to 4 carbon atoms, an unsubstituted phenyl group, an aralkyl group having from 7 to 10 carbon atoms, and a halogen atom. W represents a divalent group, each of q and r represents an integer of from 1 to 10, and each t represents an integer of from 1 to 3.

W in the above Formulae (16) and (17) is desirably any one of divalent groups represented by the following (18) to (26). In Formula (25), u represents an integer of from 0 to 3.

(18)

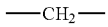

(19)

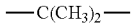

(20)

(21)

(22)

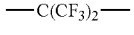

(23)

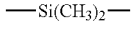

(24)

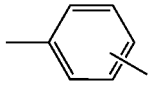

(25)

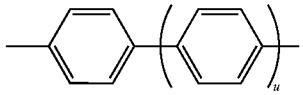

(26)

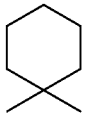

In Formula (II), when k is 0, $Ar^5$ is an aryl group of the above (1) to (7) that are exemplified in the description for $Ar^1$ to $Ar^5$, and when K is 1, $Ar^5$ is an arylene group formed by removing a hydrogen atom from the aryl group of the above (1) to (7).

Specific examples of the compound represented by Formula (I) include the following compounds, but the compound represented by Formula (I) is not limited to the examples.

I-1

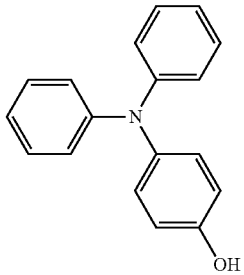

I-2

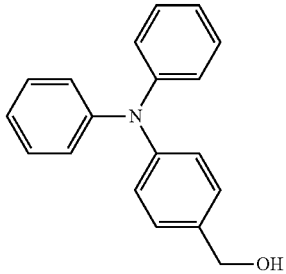

-continued
I-3
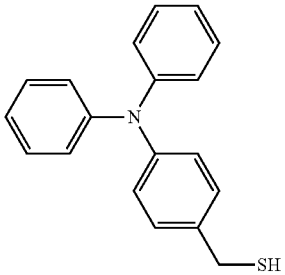
I-4
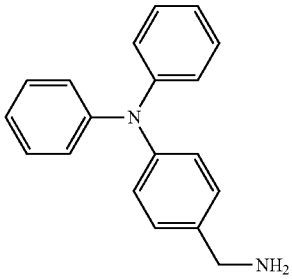
I-5
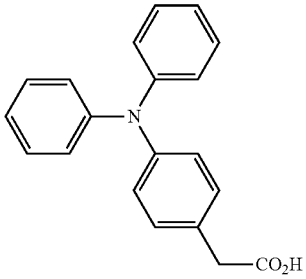
I-6
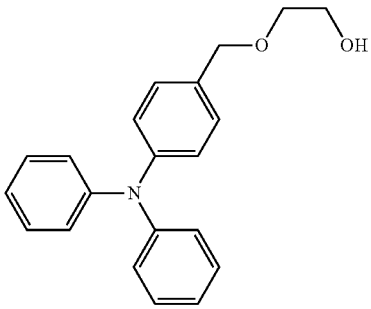
I-7
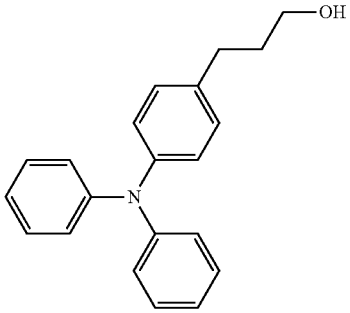
-continued
I-8
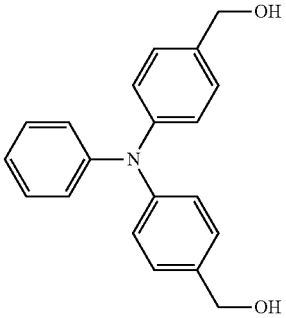
I-9
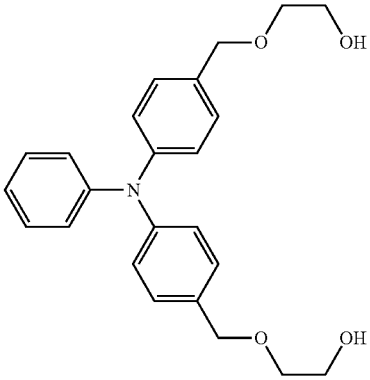
I-10
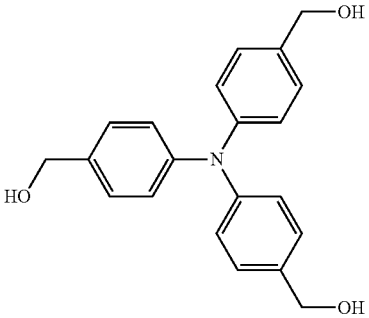
I-11
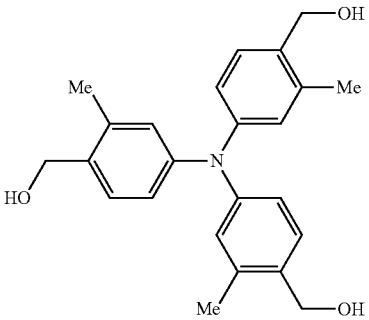

-continued
I-12
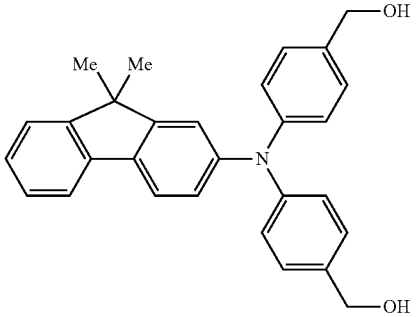
I-13
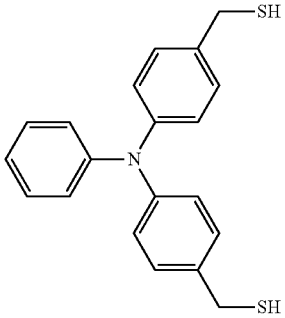
I-14
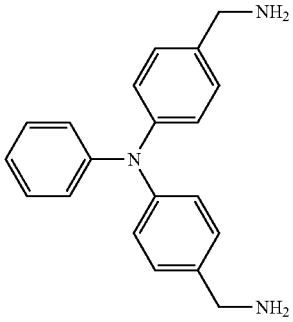
I-15
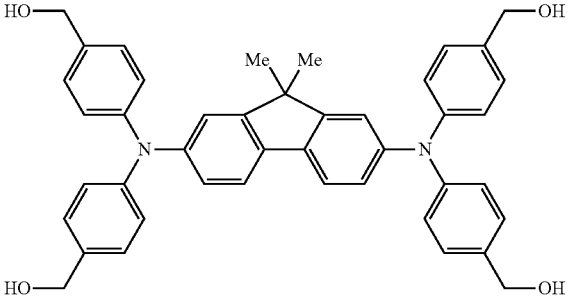
I-16
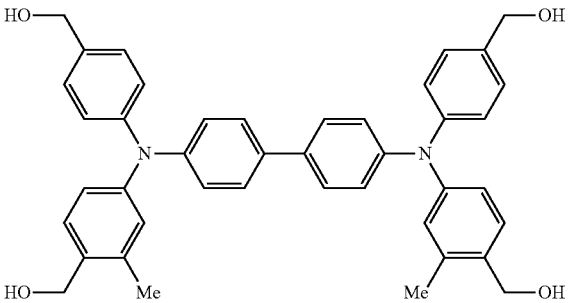
-continued
I-17
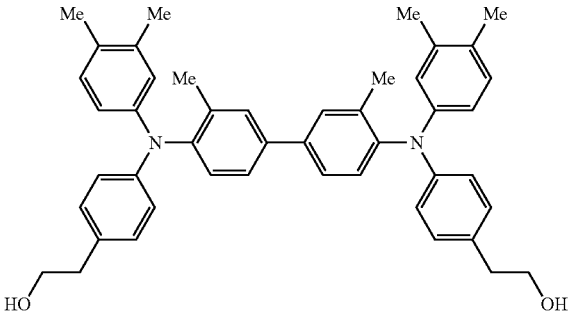
I-18
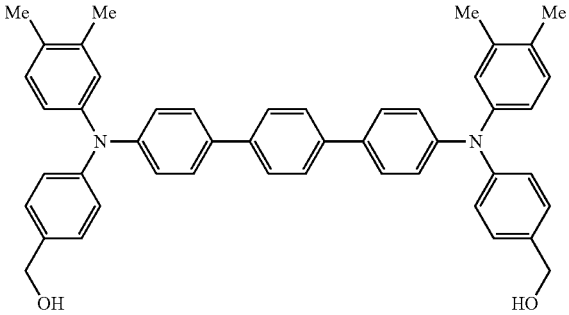
I-19
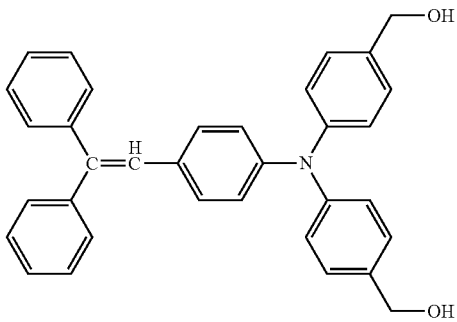
I-20
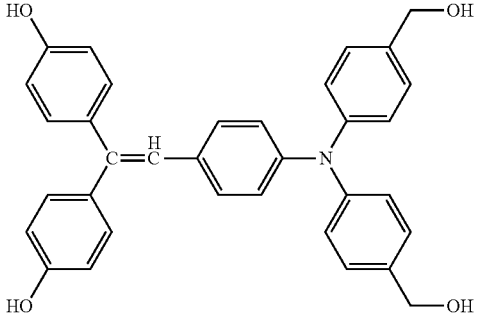

-continued
I-21
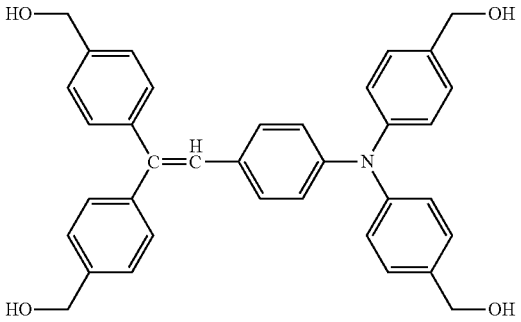
I-22
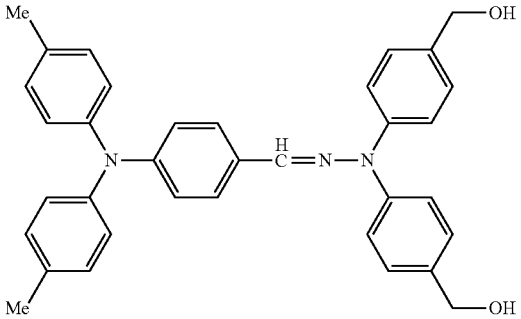
I-23
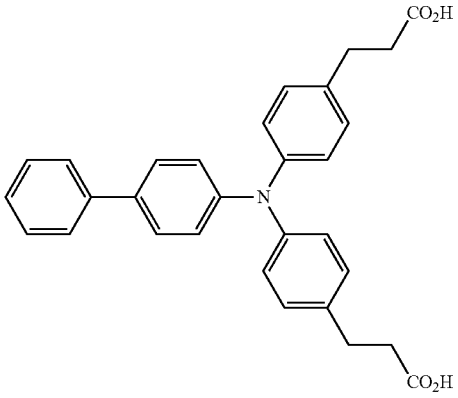
I-24
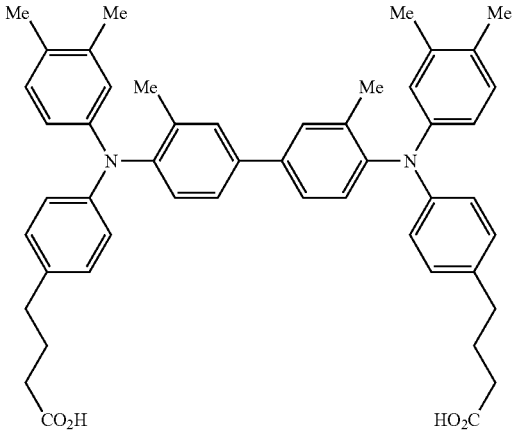
-continued
I-25
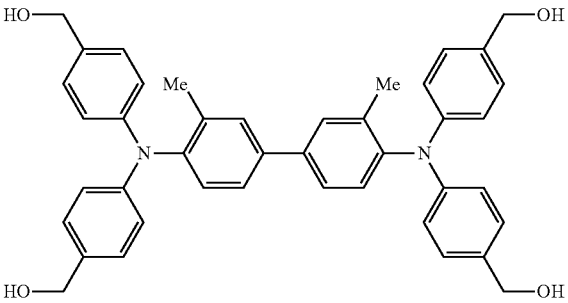
I-26
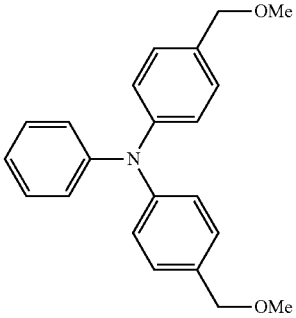
I-27
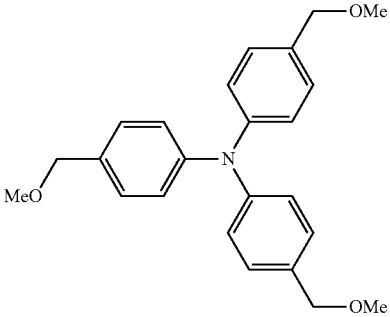
I-28
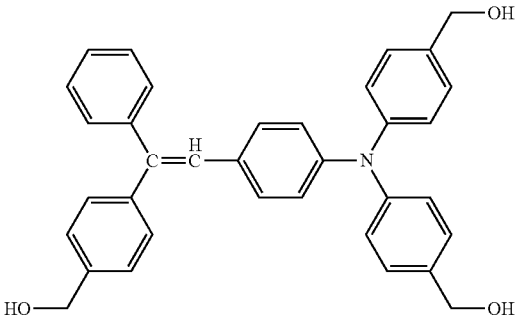

-continued

I-29

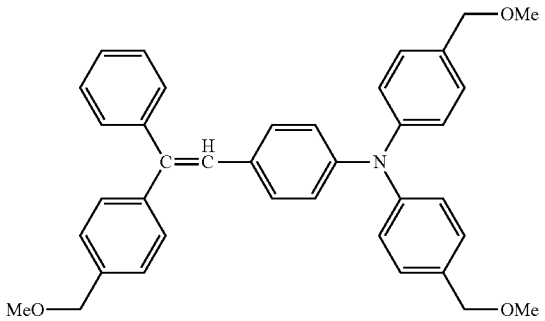

I-30

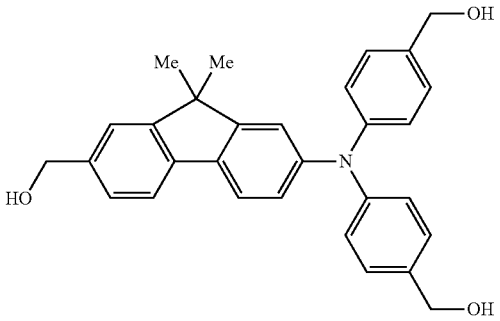

I-31

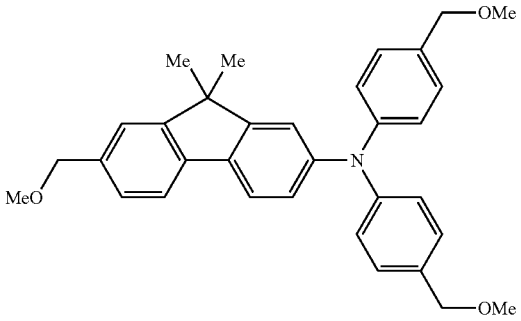

I-32

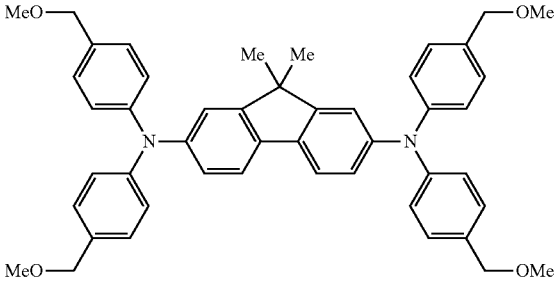

I-33

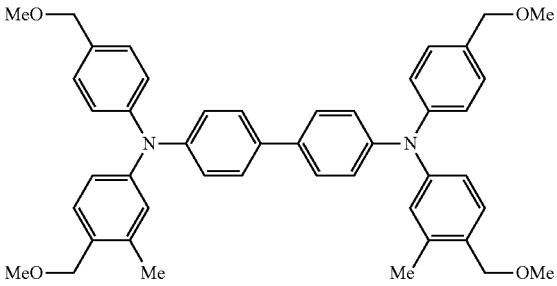

-continued

I-34

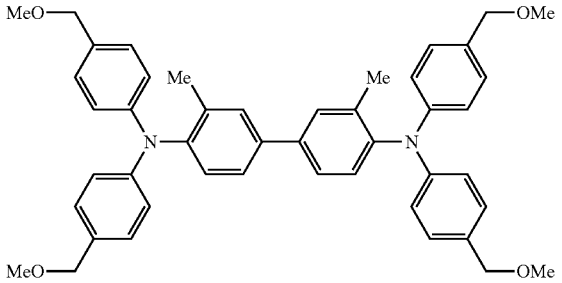

The amount of the reactive charge transporting material contained (solid content concentration in the coating liquid) is, for example, 80% by weight or more, desirably 90% by weight or more, and more desirably 95% by weight or more, based on all layer-constituting components (solid contents) excluding the fluororesin particles and the alkyl fluoride group-containing copolymer. If the solid content concentration is less than 90% by weight, there is a concern that electrical characteristics will deteriorate. The upper limit of the amount of the reactive charge transporting material contained is not limited as long as other additives effectively function with the amount, and the amount is desirably set to be large.

Herein, among the reactive charge transporting materials, a ratio (the first reactive charge transporting material/the second reactive charge transporting material) between the first reactive charge transporting material having an —OH group as a reactive functional group and the second reactive charge transporting material having an —$OCH_3$ group as a reactive functional group is desirably from 2 to 20 (or from about 2 to about 20), more desirably from 2 to 15, and even more desirably from 3 to 10 in terms of a weight ratio.

By concurrently using the first and second reactive charge transporting materials in the above ratio, the relative dielectric constant is adjusted to a range that satisfies Formula (1), and the increase in residual potential is inhibited. Moreover, the increase in the surface potential difference between an image portion and a non-image portion that is caused when images are repeatedly formed is easily inhibited.

When another reactive charge transporting material is concurrently used with the first and second reactive charge transporting materials, the amount of the concurrently used other reactive charge transporting material is desirably within 10% by weight, based on all reactive charge transporting materials.

Next, the guanamine compound will be described.

The guanamine compound is a compound having a guanamine skeleton (structure), and examples thereof include acetoguanamine, benzoguanamine, formoguanamine, steroguanamine, spiroguanamine, cyclohexylguanamine, and the like.

The guanamine compound is particularly desirably at least one kind of a compound represented by the following Formula (A) and a multimer thereof. Herein, the multimer is an oligomer that is polymerized using the compound represented by Formula (A) as a structural unit, and a degree of polymerization thereof is, for example, from 2 to 200 (desirably from 2 to 100). The compound represented by Formula (A) may be used alone, or two or more kinds of the compound may be used as a mixture. Particularly, if two or more kinds of the compound represented by Formula (A) are used as a mixture, or a multimer (oligomer) having the compound as a structural unit is used, the solubility in a solvent is improved.

(A)

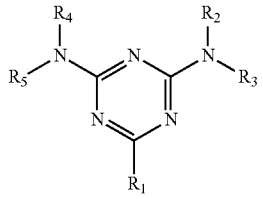

In Formula (A), $R_1$ represents a linear or branched alkyl group having from 1 to 10 carbon atoms, a substituted or unsubstituted phenyl group having from 6 to 10 carbon atoms, or a substituted or unsubstituted alicyclic hydrocarbon group having from 4 to 10 carbon atoms. Each of $R_2$ to $R_5$ independently represents —$CH_2$—OH or —$CH_2$—O—$R_6$. $R_6$ represents a linear or branched alkyl group having from 1 to 10 carbon atoms.

In Formula (A), the alkyl group represented by $R_1$ has from 1 to 10 carbon atoms, but the alkyl group desirably has from 1 to 8 carbon atoms, and more desirably has from 1 to 5 carbon atoms. This alkyl group may be linear or branched.

In Formula (A), the phenyl group represented by $R_1$ has from 6 to 10 carbon atoms, but the phenyl group more desirably has from 6 to 8 carbon atoms. Examples of substituents with which this phenyl group is substituted include a methyl group, an ethyl group, a propyl group, and the like.

In Formula (A), the alicyclic hydrocarbon group represented by $R_1$ has from 4 to 10 carbon atoms, but the alicyclic hydrocarbon group more desirably has from 5 to 8 carbon atoms. Examples of substituents with which this alicyclic hydrocarbon group is substituted include a methyl group, and ethyl group, a propyl group, and the like.

In Formula (A), the alkyl group represented by $R_6$ in "—$CH_2$—O—$R_6$" represented by $R_2$ to $R_5$ has from 1 to 10 carbon atoms, but the alkyl group desirably has from 1 to 8 carbon atoms, and more desirably has from 1 to 6 carbon atoms. This alkyl group may be linear or branched, and desirable examples thereof include a methyl group, an ethyl group, a butyl group, and the like.

The compound represented by Formula (A) is particularly desirably a compound in which $R_1$ represents a substituted or unsubstituted phenyl group having from 6 to 10 carbon atoms and each of $R_2$ to $R_5$ independently represents —$CH_2$—O—$R_6$. Moreover, $R_6$ is desirably selected from a methyl group or a n-butyl group.

The compound represented by Formula (A) is synthesized by using, for example, guanamine and formaldehyde through a known method (for example, The Chemical Society of Japan. "Experimental Chemistry Course 4$^{th}$ edition" Vol. 28, p. 430).

Hereinafter, as specific examples of the compound represented by Formula (A), example compounds (A)-1 to (A)-42 are shown, but the present exemplary embodiment is not limited to these compounds. In addition, though the following specific examples are monomers, the compounds may be multimers (oligomers) that use the monomers as a structural unit. In the following example compounds, "Me" represents a methyl group, "Bu" represents a butyl group, and "Ph" represents a phenyl group respectively.

(A)-1

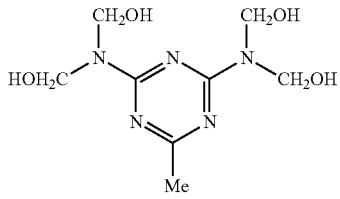

(A)-2

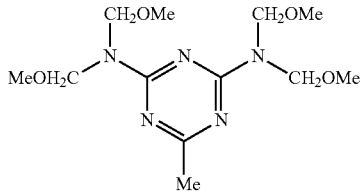

(A)-3

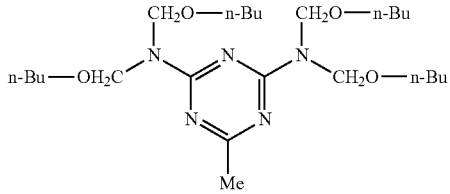

(A)-4

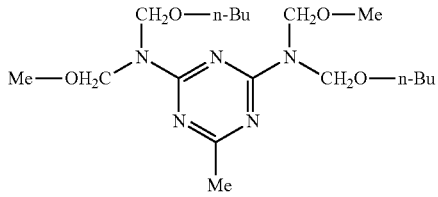

(A)-5

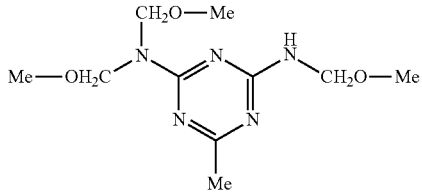

(A)-6

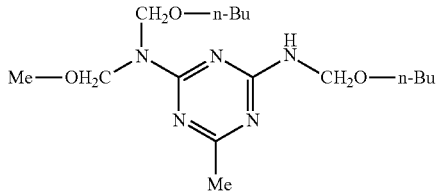

(A)-7

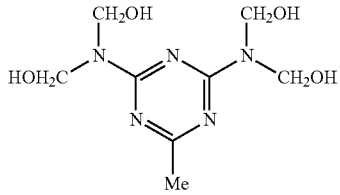

(A)-8

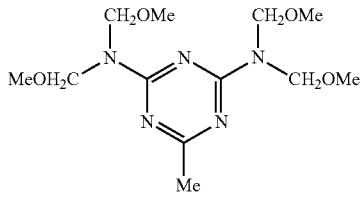

-continued
(A)-9
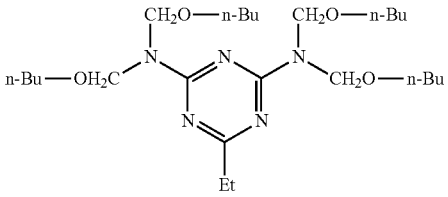
(A)-10
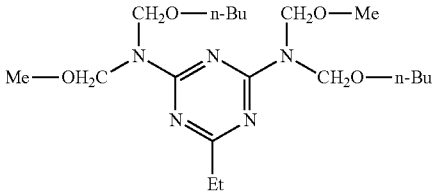
(A)-11
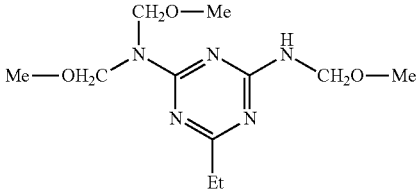
(A)-12
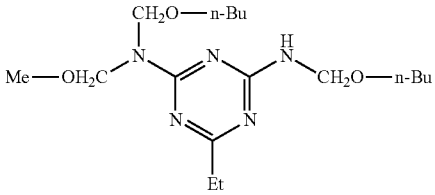
(A)-13
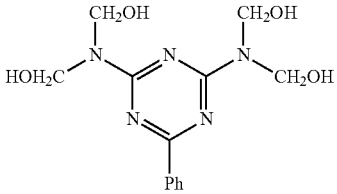
(A)-14
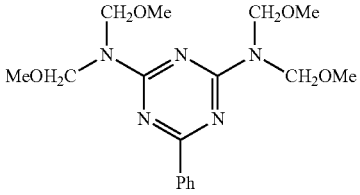
(A)-15
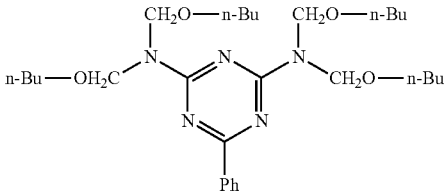
(A)-16
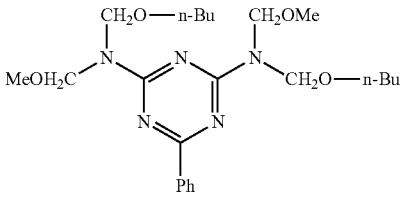
-continued
(A)-17
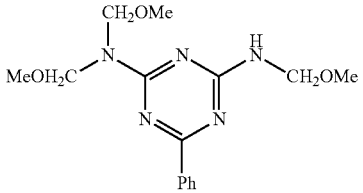
(A)-18
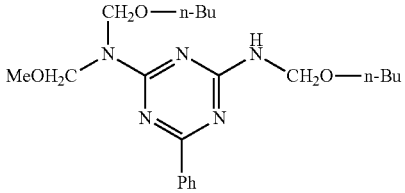
(A)-19
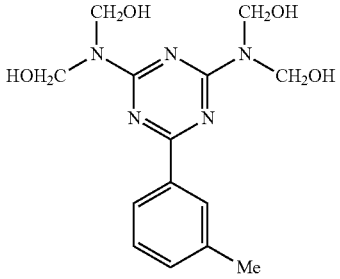
(A)-20
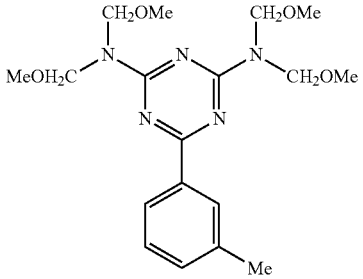
(A)-21
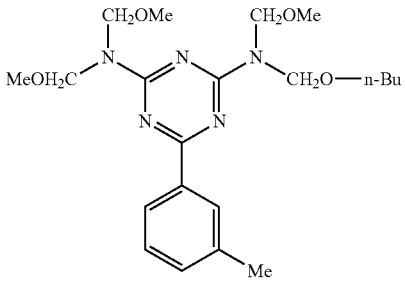
(A)-22
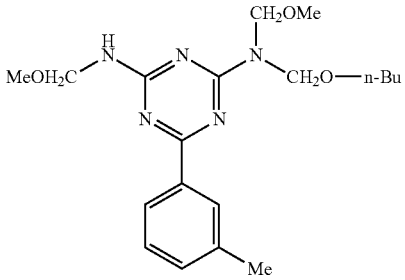

-continued
(A)-23
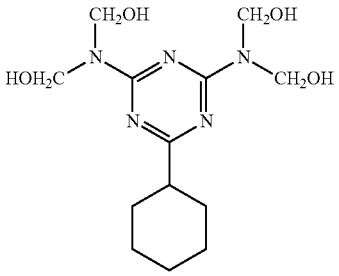
(A)-24
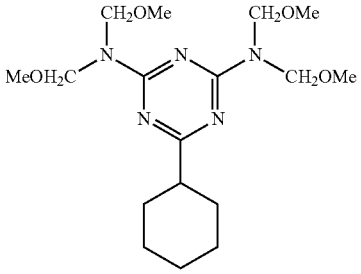
(A)-25
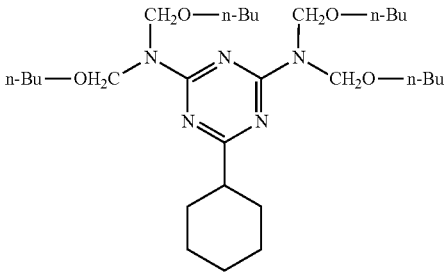
(A)-26
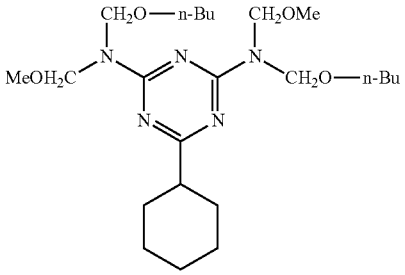
(A)-27
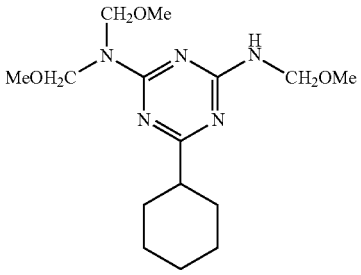
-continued
(A)-28
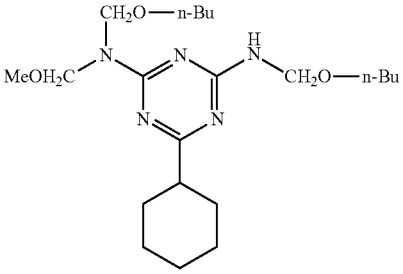
(A)-29
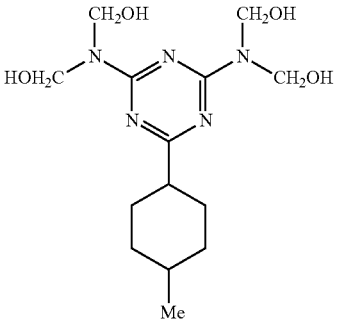
(A)-30
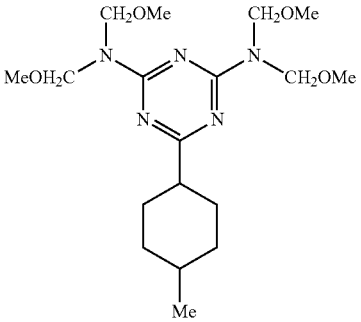
(A)-31
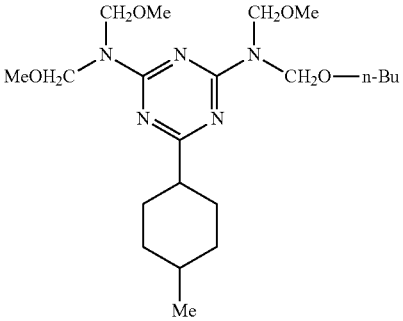
(A)-32
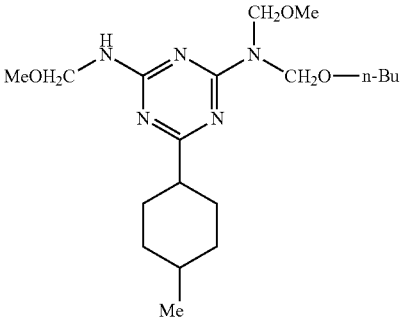

-continued (A)-33

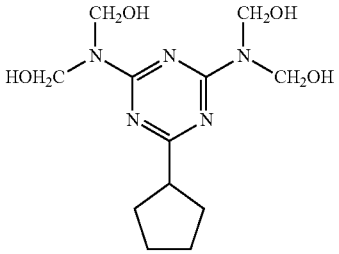

(A)-34

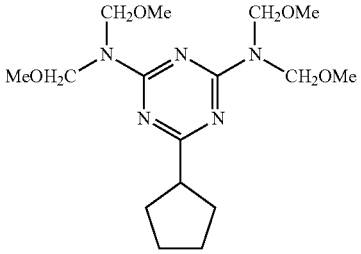

(A)-35

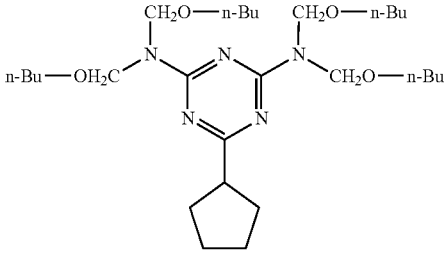

(A)-36

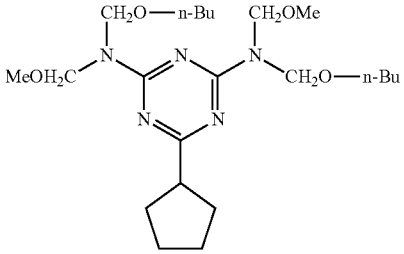

(A)-37

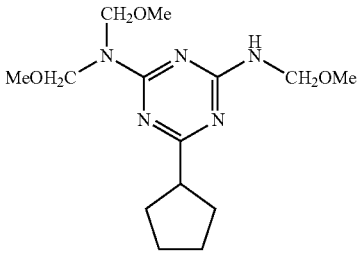

(A)-38

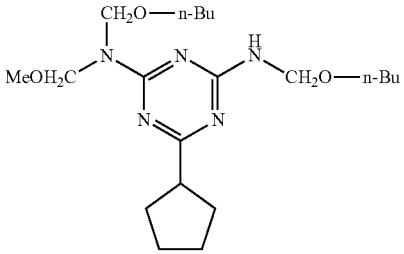

-continued (A)-39

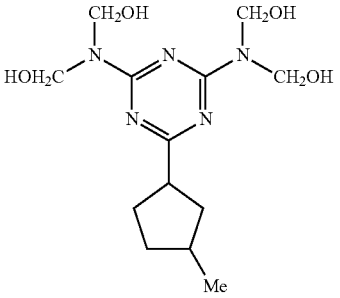

(A)-40

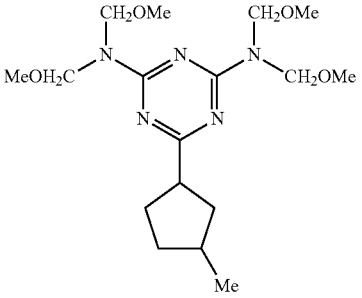

(A)-41

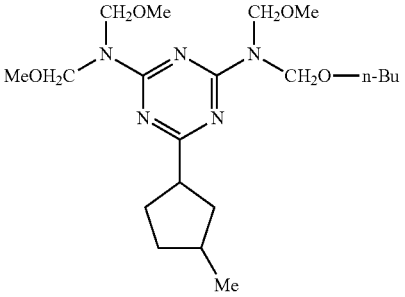

(A)-42

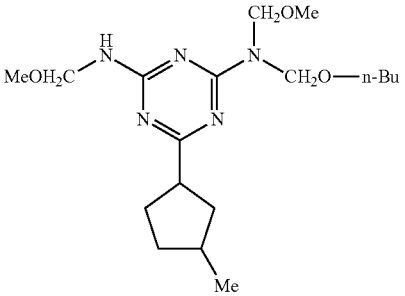

Examples of commercially available products of the compound represented by Formula (A) include Super Beckamine (R) L-148-55, Super Beckamine (R) 13-535, Super Beckamine (R) L-145-60, and Super Beckamine (R) TD-126 (all manufactured by DIC Corporation), Nikalac BL-60 and Nikalac BX-4000 (all manufactured by NIPPON CARBIDE INDUSTRIES CO., INC.), and the like.

The compound (including the multimer) represented by Formula (A) may be dissolved in an appropriate solvent such as toluene, xylene, or ethyl acetate and washed with distilled water or ion exchange water, or may be treated with an ion exchange resin, so as to remove the influence of a residual catalyst after the compound is synthesized or the commercially available products are purchased as the compound.

Next, the melamine compound will be described.

The melamine compound desirably has a melamine skeleton (structure), and particularly desirably is at least one kind of a compound represented by the following Formula (B) and a multimer thereof, Herein, just as Formula (A), the multimer is an oligomer that is polymerized using the compound represented by Formula (B) as a structural unit, and a degree of polymerization thereof is, for example, from 2 to 200 (desirably from 2 to 100). The compound represented by Formula (B) or the multimer thereof may be used alone, or two or more kinds thereof may be concurrently used. Moreover, the compound represented by Formula (A) or a multimer thereof may be used concurrently. Particularly, if a mixture of two or more kinds of the compound represented by Formula (B) is used, or a multimer (oligomer) using the compound as a structural unit is used, solubility in a solvent is improved.

(B)

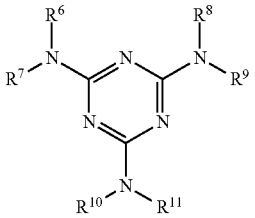

In Formula (B), each of $R^6$ to $R^{11}$ independently represents a hydrogen atom, —$CH_2$—OH, —$CH_2$—O—$R^{12}$, or —O—$R^{12}$. $R^{12}$ represents an alkyl group having from 1 to 5 carbon atoms that may be branched. Examples of the alkyl group include a methyl group, an ethyl group, a butyl group, and the like.

The compound represented by Formula (B) is synthesized using, for example, melamine and formaldehyde through a known method (for example, this compound is synthesized in the same manner as the melamine resin disclosed in The Chemical Society of Japan. "Experimental Chemistry Course 4th edition" Vol. 28, p. 430).

Hereinafter, as specific examples of the compound represented by Formula (B), example compounds (B)-1 to (B)-8 are shown, but the present exemplary embodiment is not limited to the compounds. In addition, though the following specific examples show monomers, the compounds may be multimers (oligomers) having the monomers as a structural unit.

(B)-1

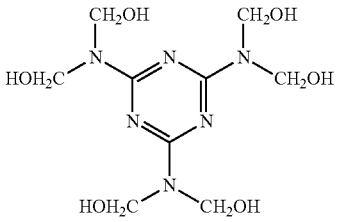

(B)-2

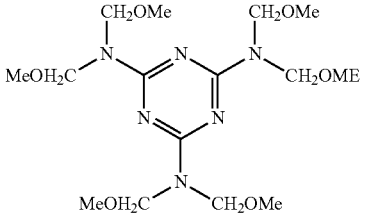

-continued (B)-3

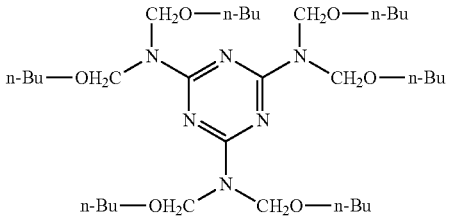

(B)-4

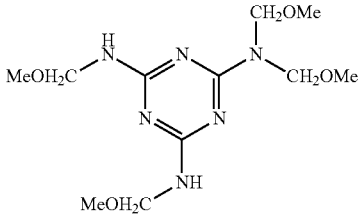

(B)-5

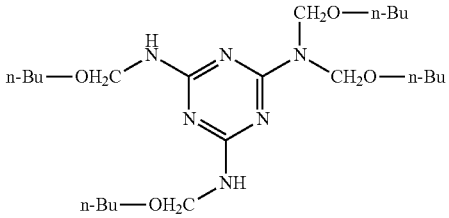

(B)-6

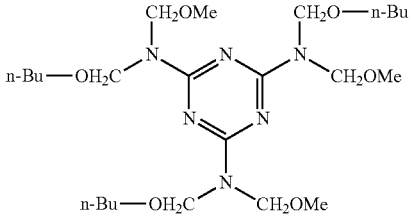

(B)-7

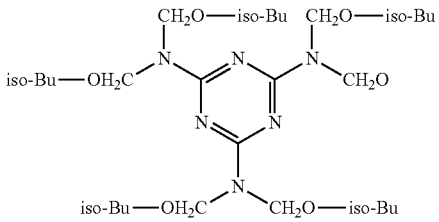

(B)-8

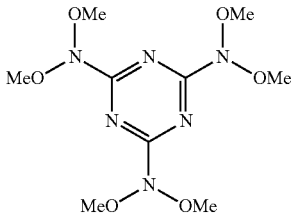

Examples of commercially available products of the compound represented by Formula (B) include Super Melami No. (manufactured by NOF CORPORATION), Super Beckamine (R) TD-139-60 (manufactured by DIC Corporation), Uban 2020 (manufactured by Mitsui Chemicals, Inc.), Sumitex Resin M-3 (manufactured by Sumitomo Chemical Co., Ltd.), Nikalac MW-30 (manufactured by NIPPON CARBIDE INDUSTRIES CO., INC.), and the like.

The compound (including the multimer) represented by Formula (B) may be dissolved in an appropriate solvent such as toluene, xylene, or ethyl acetate and washed with distilled water or ion exchange water, or may be treated with an ion exchange resin, so as to remove the influence of a residual catalyst after the compound is synthesized or the commercially available products are purchased as the compound.

Herein, the amount (solid content concentration in the coating liquid) of the at least one kind selected from the guanamine compound (compound represented by Formula (A)) and the melamine compound (compound represented by Formula (B)) contained is desirably, for example, from 0.1% by weight to 5% by weight, and more desirably from 1% by weight to 3% by weight, based on all layer-constituting components (sold contents) excluding the fluororesin particles and the alkyl fluoride group-containing copolymer. If the solid content concentration is less than 0.1% by weight, a dense film is not easily obtained, so sufficient strength is not easily obtained. If the solid content concentration exceeds 5% by weight, the electrical characteristics or resistance to a ghost (uneven density caused by image history) deteriorate in some cases.

Next, the fluororesin particles will be described.

The fluororesin particles are not particularly limited, and examples thereof include particles of polytetrafluoroethylene, a perfluoroalkoxy fluororesin, polychlorotrifluoroethylene, polyvinylidene fluoride, polydichlorodifluoroethylene, a tetrafluoroethylene-perfluoroalkyl vinyl ether copolymer, a tetrafluoroethylene-hexafluoropropylene copolymer, a tetrafluoroethylene-ethylene copolymer, or a tetrafluoroethylene-hexafluoropropylene-perfluoroalkyl vinyl ether copolymer, and the like.

The fluororesin particles may be used alone, or two or more kinds thereof may be concurrently used.

The weight average molecular weight of the fluororesin constituting the fluororesin particles is desirably, for example, from 3000 to 5000000.

The average primary particle size of the fluororesin particles is desirably, for example, from 0.01 μm to 10 μm, and more desirably from 0.05 μm to 2.0 μm.

The average primary particle size of the fluororesin particles refers to a value that is obtained by measuring a solution for measurement diluted with the same solvent as that of the dispersion in which the fluororesin particles are dispersed, at a refractive index of 1.35 by using a laser diffraction type particle size distribution analyzer LA-700 (manufactured by HORIBA, Ltd.).

Examples of commercially available products of the fluororesin particles include Lubron series (manufactured by DAIKIN INDUSTRIES, ltd.), Teflon (registered trademark) series (manufactured by DuPont), Dyneon series (manufactured by Sumitomo 3M), and the like.

The amount of the fluororesin particles contained is, for example, desirably from 1% by weight to 30% by weight, and more desirably from 2% by weight to 20% by weight, based on all layer-constituting components (solid contents).

Next, the alkyl fluoride group-containing copolymer will be described.

The alkyl fluoride group-containing copolymer has repeating units represented by the following Structural Formulae A and B.

Structural Formula A

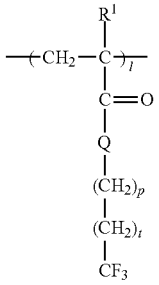

Structural Formula B

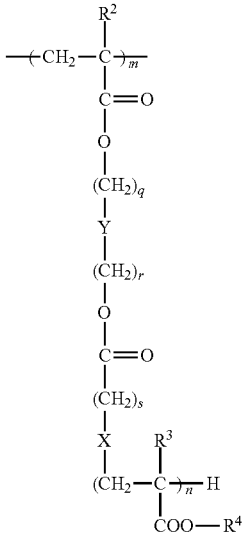

In Formulae A and B, each of $R^1$, $R^2$, $R^3$, and $R^4$ independently represents a hydrogen atom or an alkyl group.

X represents an alkylene chain, a halogen-substituted alkylene chain, —S—, —O—, —NH—, or a single bond.

Y represents an alkylene chain, a halogen-substituted alkylene chain, —($C_zH_{2z-1}$(OH))—, or a single bond.

Q represents —O— or —NH—.

Each of l, m, and n independently represents an integer of 1 or greater.

Each of p, q, r, and s independently represents 0 or an integer of 1 or greater.

t represents an integer of from 1 to 7.

z represents an integer of 1 or greater.

Herein, as groups represented by $R^1$, $R^2$, $R^3$, and $R^4$, a hydrogen atom, a methyl group, and an ethyl group are desirable, and among these, a methyl group is more desirable.

As the alkylene chain (an unsubstituted alkylene chain or a halogen-substituted alkylene chain) represented by X and Y, an alkylene chain having from 1 to 10 carbon atoms is desirable.

z in —$C_zH_{2z-1}$(OH))— represented by Y desirably represents an integer of from 1 to 10.

It is desirable that each of p, q, r, and s independently represent 0 or an integer of from 1 to 10.

In the alkyl fluoride group-containing copolymer, the content ratio between Structural Formulae (A) and (B), that is, l:m, is desirably 1:9 to 9:1, and more desirably 3:7 to 7:3.

In the Structural Formulae (A) and (B), examples of the alkyl group represented by $R^1$, $R^2$, $R^3$, and $R^4$ include a methyl group, an ethyl group, a propyl group, and the like. $R^1$, $R^2$, $R^3$, and $R^4$ are desirably a hydrogen atom and a methyl group, and among these, a methyl group is more desirable.

The alkyl fluoride group-containing copolymer may further contain a repeating unit represented by Structural Formula (C). The amount of Structural Formula (C) contained is desirably 10:0 to 7:3, and more desirably 9:1 to 7:3, as expressed by l+m:z, based on the total amount of the contained Structural Formulae (A) and (B), that is, l+m.

Structural Formula (C)

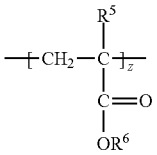

In Structural Formula (C), $R^5$ and $R^6$ represent a hydrogen atom or an alkyl group, and z represents an integer of 1 or greater.

As the group represented by $R^5$ and $R^6$, a hydrogen atom, a methyl group, and an ethyl group, are desirable, and among these, a methyl group is more desirable.

Examples of commercially available products of the alkyl fluoride group-containing copolymer include GF300 and GF400 (manufactured by TOAGOSEI CO., LTD.), Surf ion series (manufactured by AGC SEIMI CHEMICALS CO., LTD.), Ftargent series (manufactured by NEOS COMPANY LIMITED.), PF series (manufactured by KITAMURA CHEMICALS CO., LTD.), Megafac series (manufactured by DIC Corporation) FC series (manufactured by 3M), and the like.

The alkyl fluoride group-containing copolymer may be used alone, or two or more kinds thereof may be concurrently used.

The weight average molecular weight of the alkyl fluoride group-containing copolymer is, for example, desirably from 2000 to 250000, and more desirably from 3000 to 150000.

The weight average molecular weight of the alkyl fluoride group-containing copolymer is measured using gel permeation chromatography (GPC).

The amount of the alkyl fluoride group-containing copolymer contained is, for example, desirably from 0.5% by weight to 10% by weight, and more desirably from 1% by weight to 7% by weight, based on the weight of the fluororesin particles.

Next, the antioxidant will be described.

The antioxidant is an additive used to inhibit the deterioration caused by oxidizing gas such as ozone which is generated by a charging device.

Examples of the antioxidant include known antioxidants such as a hindered phenol-based antioxidant, an aromatic amine-based antioxidant, a hindered amine-based antioxidant, an organic sulfur-based antioxidant, a phosphite-based antioxidant, a dithiocarbamic acid salt-based antioxidant, a thiourea-based antioxidant, and a benzimidazole-based antioxidant.

Examples of the hindered phenol-based antioxidant include 2,6-di-t-butyl-4-methylphenol, 2,5-di-t-butylhydroquinone, N,N'-hexamethylenebis(3,5-di-t-butyl-4-hydroxyhydrocinnamide), 3,5-di-t-butyl-4-hydroxy-benzylphosphonate-diethyl ester, 2,4-bis[(octylthio)methyl]-o-cresol, 2,6-di-t-butyl-4-ethylphenol, 2,2'-methylenebis(4-methyl-6-t-butylphenol), 2,2'-methylenebis(4-ethyl-6-t-butylphenol) 4,4'-butylidenebis(3-methyl-6-t-butylphenol) 2,5-di-t-amylhydroquinone 2-t-butyl-6-(3-butyl-2-hydroxy-5-methylbenzyl)-4-methylphenyl acrylate, 4,4'-butylidenebis(3-methyl-6-t-butylphenol), and the like.

Examples of commercially available products of the hindered phenol-based antioxidant include "Irganox 1076", "Irganox 1010", "Irganox 1098", "Irganox 245", "Irganox 1330", "Irganox 3114", "Irganox 1076" (all manufactured by Ciba Specialty Chemicals, Japan), "3,5-di-t-butyl-4-hydroxybiphenyl", and the like.

Examples of aromatic amine-based antioxidant include bis(4-diethylamino-2-methylphenyl)-(4-diethylaminophenyl)-methane, bis(4-diethylamino-2-methylphenyl)-phenylmethane, and the like.

Examples of the hindered amine-based antioxidant include "Sanol LS2626", "Sanol LS765", "Sanol LS770", and "Sanol LS744" (all manufactured by Sankyo Lifetech Co., Ltd.), "Tinuvin 144" and "Tinuvin 622LD" (all manufactured by Ciba Specialty Chemicals, Japan), "Mark LA57", "Mark LA67", "Mark LA62", "Mark LA68", and "Mark LA63" (all manufactured by ADEKA CORPORATION), and the like.

Examples of the organic sulfur-based antioxidant include "Sumilizer TPS" and "Sumilizer TP-D" (all manufactured by Sumitomo Chemical Co., Ltd.).

Examples of the phosphite-based antioxidant include "Mark 2112", "Mark PEP-8", "Mark PEP-24G", "Mark PEP-36", "Mark 329K", and "Mark HP-10" (all manufactured by ADEKA CORPORATION), and the like.

Among these antioxidants, at least one kind of compound selected from bis(4-diethylamino-2-methylphenyl)-(4-diethylaminophenyl)-methane and bis(4-diethylamino-2-methylphenyl)-phenylmethane is particularly desirable. If this type of specific compound is contained, the relative dielectric constant is adjusted to a range that satisfies Formula (1), and the increase in residual potential is inhibited. Moreover, the increase in the surface potential difference between an image portion and a non-image portion that is caused when images are repeatedly formed is easily inhibited.

The amount of the antioxidant added is desirably 20% by weight or less, and more desirably 10% by weight or less, based on all layer-constituting components (solid contents) excluding the fluororesin particles and the alkyl fluoride group-containing copolymer.

Hereinafter, the surface protective layer will be described in more detail.

For the surface protective layer, the reactive charge transporting material (for example, the compound represented by Formula (1)) may be concurrently used with a phenol resin, a urea resin, an alkyd resin, and the like. Moreover, in order to improve strength, it is also effective to copolymerize a compound that has a larger number of functional groups in a molecule, such as a spiroacetal-based guanamine resin (for example, "CTU-guanamine" manufactured by Ajinomoto Fine-Techno Co., Inc.) with the material in the crosslinked substance.

The surface protective layer may be used by being mixed with other thermosetting resins such as a phenol resin, in order that oxidation caused by gas generated by discharge is effectively inhibited by these resins which are added to prevent the surface protective layer from adsorbing too much gas generated by discharge.

A surfactant may be added to the surface protective layer. The surfactant is not particularly limited so long as it has at least one or more kinds of structures among containing fluorine atoms, an alkylene oxide structure, and a silicone structure. However, a surfactant having plural structures described above is suitably exemplified since such a surfactant exhibits high affinity and compatibility to the charge transporting organic compound, improves the film formability of the coating liquid for forming a surface protective layer, and inhibits wrinkles and unevenness of the surface protective layer.

For the purposes of adjusting film formability, flexibility, lubricity, and adhesiveness, the surface protective layer may be used by being mixed with a coupling agent or a fluorine compound. As such a compound, various silane coupling agents and commercially available silicone-based hard coating agents are used.

For the purposes of controlling the discharge gas resistance of the surface protective layer, mechanical strength, damage resistance, particle dispersibility, and viscosity, the purpose of reducing torque, the purpose of controlling an abrasion amount, and the purpose of extending pot life (storability of the coating liquid for forming a layer), or the like, an alcohol-soluble resin may be added.

Herein, the alcohol-soluble resin refers to a resin which is dissolved at 1% by weight or more in an alcohol having 5 or less carbon atoms. Examples of the resin soluble in an alcohol-based solvent include a polyvinyl acetal resin and a polyvinyl phenol resin.

For the purpose of decreasing residual potential or improving strength, various particles may be added to the surface protective layer. An example of the particles includes silicon-containing particles. The silicon-containing particles are particles containing silicon as a constituent element, and specific examples thereof include colloidal silica, silicone particles, and the like.

For the same purpose, oil such as silicone oil may be added to the surface protective layer.

A metal, metallic oxide, carbon black, and the like may be added to the surface protective layer.

The surface protective layer is desirably a cured film (crosslinked film) that is obtained by polymerizing (crosslinking) at least one kind selected from a reactive charge transporting material and optionally a guanamine compound and a melamine compound by using an acid catalyst. As the acid catalyst, aliphatic carboxylic acids such as acetic acid, chloroacetic acid, trichloroacetic acid, trifluoroacetic acid, oxalic acid, maleic acid, malonic acid, and lactic acid; aromatic carboxylic acids such as benzoic acid, phthalic acid, terephthalic acid, and trimellitic acid; aliphatic and aromatic sulfonic acids such as methanesulfonic acid, dodecylsulfonic acid, benzenesulfonic acid, dodecylbenzenesulfonic acid, and naphthalenesulfonic acid; and the like are used. However, it is desirable to use sulfur-containing materials.

The amount of the catalyst mixed is desirably in a range of from 0.1% by weight to 50% by weight, and particularly desirably in a range of from 10% by weight to 30% by weight, based on all layer-constituting components (solid contents) excluding the fluororesin particles and the alkyl fluoride group-containing copolymer. If the mixed amount is less than the above range, the catalytic activity is lowered too much in some cases, and if the mixed amount exceeds the above range, lightfastness deteriorates in some cases. The lightfastness refers to a phenomenon in which the density of a portion irradiated with light is decreased when the photosensitive layer is exposed with light from an external environment such as indoor light. The reason is unclear, but it is presumed that such a phenomenon occurs due to a phenomenon similar to an optical memory effect as disclosed in JP-A-5-099737.

The surface protective layer constituted in the above manner is formed using a coating liquid for forming a surface protective layer that is obtained by mixing the above components. The coating liquid for forming a surface protective layer may be prepared without using a solvent or may be prepared optionally using a solvent. The solvent may be used alone, or two or more kinds thereof may be used as a mixture, and a boiling point of the solvent is desirably 100° C. or lower. As the solvent, it is particularly desirable to use a solvent (for example, alcohols and the like) having at least one or more kinds of hydroxyl groups.

When the coating liquid is obtained by reacting the above components, the components may be simply mixed and dissolved. However, the components may be heated at room temperature (for example, 25° C.) to 100° C., desirably at 30° C. to 80° C., for 10 minutes to 100 hours, desirably for 1 hour to 50 hours. At this time, it is also desirable to irradiate the components with ultrasonic waves. In this manner, partial reaction may be caused, and a film showing less coating defectiveness and less thickness variation is easily obtained.

The coating liquid for forming a surface protective layer is then coated by a known method such as blade coating, wire bar coating, spray coating, dip-coating, bead coating, air knife coating, or curtain coating, and optionally cured by being heated at, for example, 100° C. to 170° C., whereby a surface protective layer is obtained.

So far, a functional separation type electrophotographic photoreceptor has been described for example. However, for example, when a single layer type photosensitive layer (charge generating and transporting layer) shown in FIG. 3 is formed, the amount of the charge generating material contained is desirably from about 10% by weight to 85% by weight, and more desirably from 20% by weight to 50% by weight. In addition, the amount of the charge transporting material contained is desirably from 5% by weight to 50% by weight.

The method of forming the single layer type photosensitive layer is the same as the method of forming the charge generating layer or the charge transporting layer. The thickness of the single layer type photosensitive layer is desirably from about 5 μm to 50 μm, and more desirably from 10 μm to 40 μm.

[Image Forming Apparatus Process Cartridge]

Figure 4:
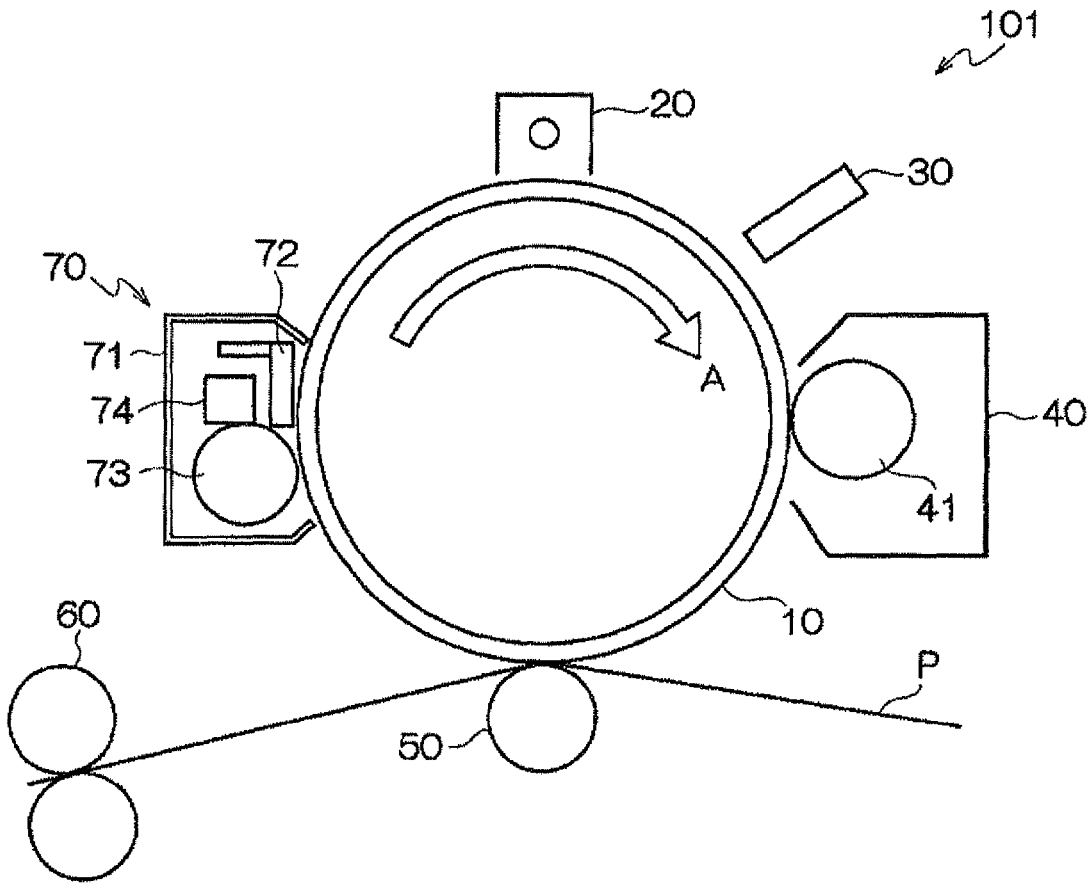
FIG. 4 is a schematic constitution view showing an image forming apparatus according to the present exemplary embodiment.

FIG. 4 is a schematic constitution view showing the image forming apparatus according to the present exemplary embodiment.

As shown in FIG. 4, an image forming apparatus 101 according to the present exemplary embodiment includes, for example, an electrophotographic photoreceptor 10 that rotates clockwise as indicated by an arrow A, a charging device 20 (an example of a charging unit) that is provided at the top of the electrophotographic photoreceptor 10 while facing the electrophotographic photoreceptor 10 and charges the surface of the electrophotographic photoreceptor 10, an exposure device 30 (an example of an electrostatic latent image-forming unit) that exposes the surface of the electrophotographic photoreceptor 10 charged by the charging device 20 with light and forms an electrostatic latent image, a developing device (an example of developing unit) that attaches a toner contained in a developer to the electrostatic latent image formed by the exposure device 30 and forms a toner image on the surface of the electrophotographic photoreceptor 10, a transfer device 50 that charges a recording paper P (transfer medium) with a polarity different from the polarity of the charged toner and transfers the toner image formed on the electrophotographic photoreceptor 10 to the recording paper P, and a cleaning device 70 (an example of a toner removing unit) that cleans the surface of the electrophotographic photoreceptor 10. The image forming apparatus 101 is also provided with a fixing device 60 that fixes the toner image while transporting the recording paper P in which the toner image is formed.

Hereinafter, the main constituent members of the image forming apparatus 101 according to the present exemplary embodiment will be described in detail.

—Charging Device—

Examples of the charging device 20 include a contact type charger using a conductive charging roller, a charging brush, a charging film, a charging rubber blade, a charging tube, or the like. The examples of the charging device 20 also include known chargers such as a non-contact type of roll charger, a scorotron charger using corona discharge, and a corotron charger. As the charging device 20, a contact type charger is desirable.

—Exposure Device—

Examples of the exposure device 30 include an optical system instrument or the like that exposes the surface of the electrophotographic photoreceptor 10 with light such as a semiconductor laser beam, LED light, or liquid crystal shutter light in an image pattern. The wavelength of a light source is desirably in the spectral sensitivity region of the electrophotographic photoreceptor 10. As the wavelength of the semiconductor laser, near infrared radiation having an oscillation wavelength near 780 nm is desirably used. However, the wavelength is not limited thereto, and lasers such as a laser having an oscillation wavelength of about 600 nm and a blue laser having an oscillation wavelength of from 400 nm to 450 nm may also be used. In addition, as the exposure device 30, in order to form color images, for example, a surface-emitting type of laser beam source which outputs a multi-beam is also effective.

—Developing Device—

As the developing device 40, a constitution is exemplified in which a developing roll 41 disposed in a developing area so as to face the electrophotographic photoreceptor 10 is provided in a container that contains a two-component developer including a toner and a carrier. As the developing device 40, a known constitution is employed without particular limitation so long as the device develops images by the two-component developer.

Herein, the developer used in the developing device 40 will be described.

The developer may be either a single-component developer including a toner or a two-component developer including a toner and a carrier.

The toner is constituted with, for example, a binder resin, a colorant, optionally toner particles containing other additives such as a release agent, and optionally external additives.

The average shape factor (average shape factor number expressed by shape factor=$(ML^2/A)\times(\pi/4)\times100$, ML herein represents a maximum length of particles, and A represents a projected area of the particles) of the toner particles is desirably from 100 to 150, more desirably from 105 to 145, and even more desirably from 110 to 140. The volume average particle size of the toner is desirably from 3 μm to 12 μm, and more desirably from 3.5 μm to 10 μm, and even more desirably from 4 μm to 9 μm.

The toner particles are not particularly limited in terms of the preparation method. For example, toner particles are used which are prepared by a kneading and pulverizing method that kneads, pulverizes, and classifies a binder resin, a colorant, a release agent, and optionally a charge-controlling agent together; a method that changes the shape of the particles obtained by the kneading and pulverizing method by using mechanical impact or heat energy; an emulsion polymerization aggregation method in which polymerizable monomers of a binder resin are emulsion-polymerized to form a dispersion, the dispersion is mixed with a colorant, a release agent, and optionally with a dispersion of a charge-controlling agent or the like, followed by aggregation and heat melting, thereby obtaining toner particles; a suspension polymerization method in which polymerizable monomers for obtaining a binder resin, a colorant, a release agent, and optionally a solution of a charge-controlling agent or the like are suspended in an aqueous solvent, followed by polymerization; a dissolution suspension method in which a binder resin, a colorant, a release agent, and optionally a solution of a charge-controlling agent are suspended in an aqueous solvent to produce particles; or the like.

In addition, a known method such as a method of creating a core shell structure by further attaching aggregated particles to the toner particles as a core obtained by the above-described method and performing heat melting may be used. As the method of preparing a toner, the suspension polymerization method preparing a toner by using an aqueous solvent, the emulsion polymerization aggregation method, and the dissolution suspension method are desirable from the viewpoint of controlling the shape and particle size distribution, and particularly, the emulsion polymerization aggregation method is desirable.

The toner is prepared by mixing the toner particles with the additives described above by using a Henschel mixer or a V blender. When the toner particles are prepared through a wet method, the particles may be externally added through the wet method.

When the toner is used as the two-component developer, the mixing ratio between the toner and the carrier is set in a known ratio. In addition, though the carrier is not particularly limited, a carrier obtained by coating the surface of magnetic particles with a resin is suitably exemplified as the carrier.

—Transfer Device—

Examples of the transfer device 50 include known transfer chargers such as a contact-type transfer charger using a belt, a roller, a film, a rubber blade, or the like, a scorotron transfer charger using corona discharge, and a corotron transfer charger.

(Cleaning Device)

The cleaning device 70 is constituted with, for example, a case 71, a cleaning blade 72, and a cleaning brush 73 that is disposed at the downstream side of the cleaning blade 72 in the rotation direction of the electrophotographic photoreceptor 10. In addition, a solid-like lubricant 74 is disposed while contacting the cleaning brush 73.

Hereinafter, the operation of the image forming apparatus 101 according to the present exemplary embodiment will be described. First, the electrophotographic photoreceptor 10 rotates along the direction indicated by the arrow a, and at the same time, the electrophotographic photoreceptor 10 is charged negatively by the charging device 20.

The electrophotographic photoreceptor 10 of which the surface has been charged negatively by the charging device 20 is exposed with light by the exposure device 30, whereby a latent image is formed on the surface of the electrophotographic photoreceptor 10.

The portion of the electrophotographic photoreceptor 10 where the latent image has been formed approaches the developing device 40, a toner is attached to the latent image by the developing device 40 (developing roll 41), whereby a toner image is formed.

When the electrophotographic photoreceptor 10 in which the toner image has been formed further rotates in the direction of the arrow a, the toner image is transferred to the recording paper P by the transfer device 50. As a result, the toner image is formed on the recording paper P.

In the recording paper P in which the image is formed, the toner image is fixed by the fixing device 60.

Figure 5:
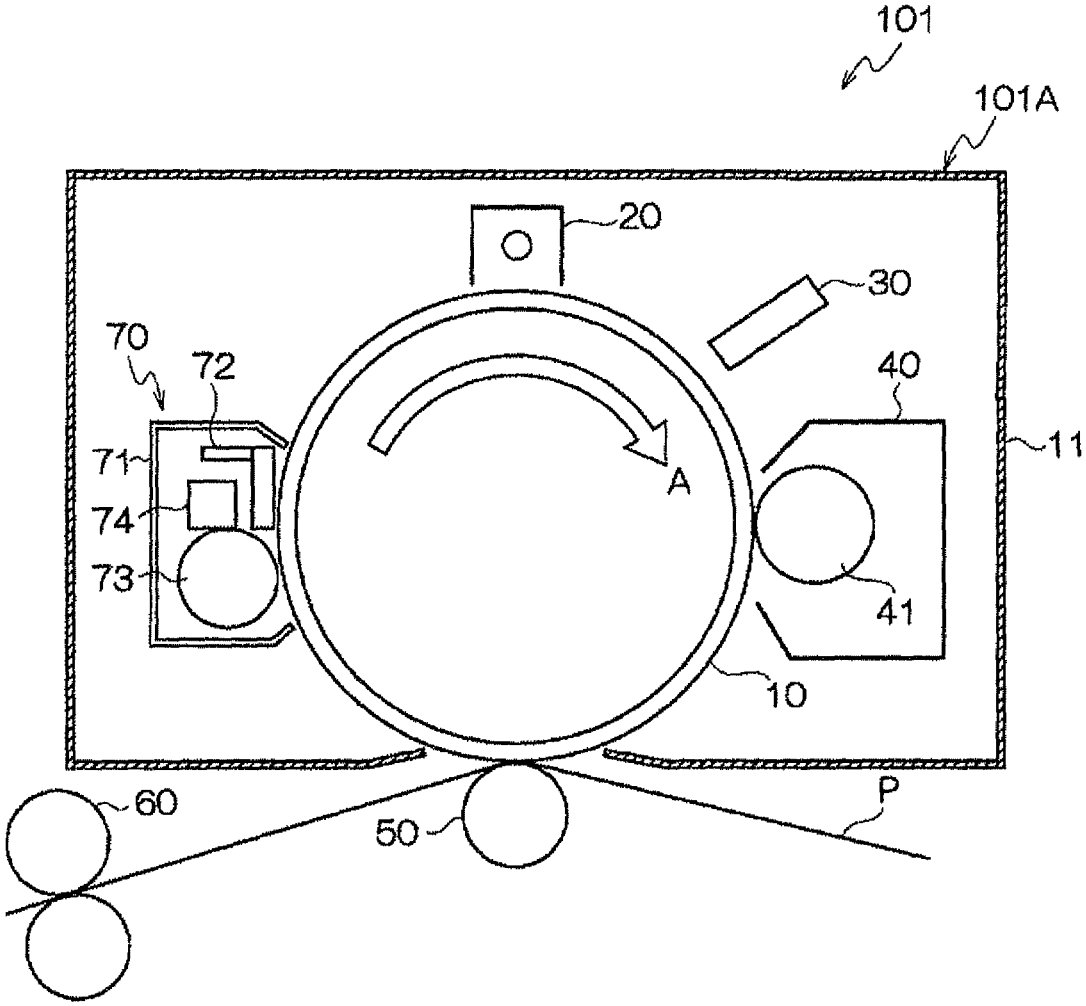
FIG. 5 is a schematic constitution view showing another image forming apparatus according to the present exemplary embodiment.

The image forming apparatus 101 according to the present exemplary embodiment may have, for example, a form in which the image forming apparatus 101 is provided with a process cartridge 101A that integrally accommodates the electrophotographic photoreceptor 10, the charging device 20, the exposure device 30, the developing device 40, and the cleaning device 70 in a case 11, as shown in FIG. 5. This process cartridge 101A integrally accommodates plural members and is detached from or attached to the image forming apparatus 101.

The constitution of the process cartridge 101A is not limited to the above form. For example, the process cartridge 101A may include at least the electrophotographic photoreceptor 10. In addition, for example, the process cartridge 101A may include at least one member selected from the charging device 20, the exposure device 30, the developing device 40, the transfer device 50, and the cleaning device 70.

The image forming apparatus 101 according to the present exemplary embodiment is not limited to the above constitution. For example, the image forming apparatus 101 may have a form in which a first erasing device that aligns the polarity of the residual toner so as to make it easier to remove the toner by using a cleaning brush is disposed in a position which is around the electrophotographic photoreceptor 10 and at the downstream side from the transfer device 50 in the rotation direction of the electrophotographic photoreceptor 10 and at the upstream side from the cleaning device 70 in the rotation direction of the electrophotographic photoreceptor. Alternatively, the image forming apparatus 101 may have a form in which a second erasing device that erases the surface of the electrophotographic photoreceptor 10 is disposed at the downstream side from the cleaning device 70 in the rotation direction of the electrophotographic photoreceptor and at the upstream side from the charging device 20 in the rotation direction of the electrophotographic photoreceptor.

Moreover, the image forming apparatus 101 according to the present exemplary embodiment is not limited to the above constitution. The image forming apparatus 101 may employ a known constitution, for example, either an intermediate transfer type-image forming apparatus in which the toner image formed on the electrophotographic photoreceptor 10 is transferred to an intermediate transfer member and then transferred to the recording paper P, or a tandem type image forming apparatus.

EXAMPLES

Hereinafter, the present invention will be described in more detail based on examples and comparative examples, but the present invention is not limited to the following examples.

Example 1

—Formation of Undercoat Layer—

100 parts by weight of zinc oxide (average particle size of 70 nm: manufactured by TAYCA: specific surface area of 15 $m^2/g$) is mixed with 500 parts by weight of tetrahydrofuran under stirring, and 1.25 part by weight of KBM603 (manufactured by Shin-Etsu Chemical Co., Ltd.) is added thereto as a silane coupling agent, followed by stirring for 2 hours. Thereafter, tetrahydrofuran is distilled away through distillation under reduced pressure, and the resultant is baked at 120° C. for 3 hours, thereby obtaining zinc oxide particles that are surface-treated with the silane coupling agent.

Thereafter, 38 parts by weight of a solution obtained by dissolving 60 parts by weight of the zinc oxide particles having undergone the surface treatment, 0.6 part by weight of alizarin, 13.5 parts by weight of blocked isocyanate (Sumidur 3173, manufactured by Sumika Bayer Urethane Co., Ltd.) as a curing agent, and 15 parts by weight of a butyral resin (S-LEC BM-1, manufactured by SEKISUI CHEMICAL CO., LTD.) in 85 parts by weight of methyl ethyl ketone is mixed with 25 parts by weight of methyl ethyl ketone, and the resultant is dispersed with a sand mill for 4 hours by using glass beads having a diameter of 1 mm, thereby obtaining a dispersion.

Subsequently, 0.005 part by weight of dioctyltin dilaurate as a catalyst and 4.0 parts by weight of silicone resin particles (Tospearl 145, manufactured by GE Toshiba Silicones, Co., Ltd.) are added to the obtained dispersion, thereby obtaining a coating liquid for an undercoat layer. This coating liquid is coated onto an aluminum substrate having a diameter of 30 mm by dip-coating, followed by drying and curing at 180° C. for 40 minutes, thereby forming an undercoat layer having a thickness of 25 μm.

—Formation of Charge Generating Layer—

Thereafter, as a charge generating material, a mixture including 15 parts by weight of chlorogallium phthalocyanine crystals that has strong diffraction peaks at the Bragg angles (2θ±0.2°) of at least 7.4°, 16.6°, 25.5°, and 28.3° with respect to an X-ray diffraction spectrum having CuKα characteristics, 10 parts by weight of a vinyl chloride-vinyl acetate copolymer resin (VMCH, manufactured by Nippon Unicar Co., Ltd.), and 300 parts by weight of n-butyl alcohol is dispersed with a sand mill for 4 hours by using glass beads having a diameter of 1 mm, thereby obtaining a coating liquid for a charge generating layer. This coating liquid for a charge generating layer is coated onto the undercoat layer by dip-coating, followed by drying at 120° C. for 5 minutes, thereby forming a charge generating layer having a film thickness of 0.2 μm.

—Formation of Charge Transporting Layer—

Subsequently, 2 parts by weight of N,N'-bis(3-methylphenyl)-N,N'-diphenylbenzidine, 2 parts by weight of N,N'-bis(3,4-dimethylphenyl)biphenyl-4-amine, and parts by weight of a bisphenol Z polycarbonate resin (viscosity average molecular weight: 40,000) as charge transporting materials, and 0.1 part by weight of 2,6-di-t-butyl-4-methylphenol as an antioxidant are mixed and dissolved in 24 parts by weight of tetrahydrofuran and 11 parts by weight of toluene, thereby obtaining a coating liquid for forming a charge transporting layer.

This coating liquid for forming a charge transporting layer is coated onto the charge generating layer by dip-coating, followed by drying at 120° C. for 40 minutes, thereby forming a charge transporting layer having a thickness of 22 μm.

—Formation of Surface Protective Layer—

Next, 10 parts by weight of ethylene tetrafluoride resin particles ("Lubron L-2" manufactured by DIC Corporation) as the fluororesin particles and 0.3 part by weight of an alkyl fluoride group-containing copolymer (weight average molecular weight of 50,000, l:m=1:1, s=1, n=60) containing the repeating unit represented by the following Structural Formula (2) are sufficiently mixed with 40 parts of cyclopentanone under stirring, thereby preparing an ethylene tetrafluoride resin particle suspension.

Thereafter, 45 parts by weight of an example compound (T-8) as the first reactive charge transporting material, 15 parts by weight of an example compound (1-26) as the second reactive charge transporting material, 4 parts by weight of an example compound (A)-17 (benzoguanamine compound "Nikalac EL-60" manufactured by Sanwa Chemical co., LTD.) as a guanamine compound, and 1.5 parts by weight of bis(4-diethylamino-2-methylphenyl)-(4-diethylaminophenyl)-methane as an antioxidant are added to 220 parts by weight of cyclopentanone and sufficiently dissolved and mixed, and the ethylene tetrafluoride resin particle suspension is further added thereto, followed by mixing under stirring.

Then a dispersing treatment is repeatedly performed 20 times on the obtained mixed solution, by using a high pressure homogenizer (manufactured by Yoshida Kikai Co., Ltd. YSNM-1500AR) on which a penetration type chamber having a fine flow path is mounted and by increasing pressure to 700 kgf/cm$^2$. Thereafter, 1 part by weight of dimethyl polysiloxane (Glano1450, KYOEISHA CHEMICAL Co., LTD.) and 0.1 part by weight of NACURE 5225 (manufactured by King Industries, Inc) as a curing catalyst are added thereto, thereby preparing a coating liquid for forming a protective layer.

This coating liquid for a surface protective layer is coated onto the charge transporting layer by dip-coating, followed by drying at 155° C. for 35 minutes, thereby forming a surface protective layer having a film thickness of about 6 μm.

Structural Formula (2)

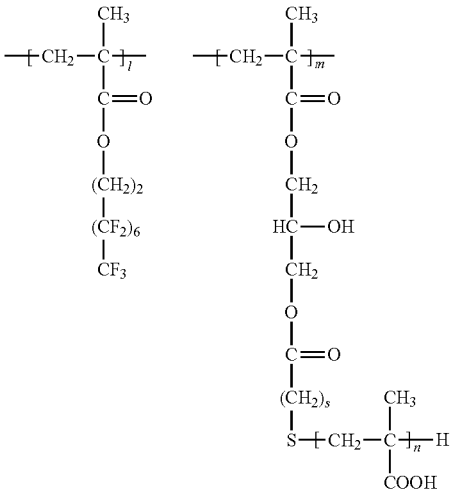

An electrophotographic photoreceptor is obtained through the above steps, and the obtained electrophotographic photoreceptor is named a photoreceptor 1.

Examples 2 to 16 and Comparative Examples 1 to 6

Electrophotographic photoreceptors are obtained in the same manner as in Example 1, except that the composition of the surface protective layer is changed according to Tables 1 to 3. These photoreceptors are named photoreceptors 2 to 16 and comparative photoreceptors 1 to 6.

(Evaluation)

The characteristics of the surface protective layer are investigated with respect to the photoreceptors obtained in the respective examples. In addition, the evaluation of black spots, fogging, and white spots caused by the increase in residual potential and the evaluation of printed ghost caused by the increase in surface potential difference between an image portion and a non-image portion are performed. The results of the evaluations are shown in Tables 4 and 5.

—Characteristics of Surface Protective Layer—

As characteristics of the surface protective layer, the relative dielectric constant ∈r, the charge amount Q [C/mm$^2$] of carrier traps, the volume resistivity ρ [Ω·m], and the ionization potential IP(OCL) [eV] are investigated by the methods described above.

In addition, the ionization potential IP(CTL) of the charge transporting layer is investigated by the method described above, and the difference between the ionization potential IP(OCL) [eV] of the surface protective layer and the ionization potential IP(CTL) is investigated.

—Evaluation of Black Spots, Fogging, and White Spots—

The photoreceptors obtained in the respective examples are mounted on DocuCentre-IIC7500 manufactured by Fuji Xerox Co., Ltd., and then 4,000,000 sheets of half tone images having an image density of 5% are printed on A4 paper.

Subsequently, a printing test for a white sheet and a printing test for half tone (image density of 30%) are performed to investigate the state of black spots, fogging, and white spots caused.

The evaluation criteria are as follows.

A: not caused
B: caused to an extremely slight degree
C: caused slightly
D: caused to a not allowable level —Evaluation of Printed Ghost—

The photoreceptors obtained in the respective examples are mounted on a DocuCentre-IIC7500 manufactured by Fuji Xerox Co., Ltd., and then 4,000,000 sheets of grid-like images are printed on A4 paper.

Subsequently, a printing test for half tone (image density of 30%) is performed to investigate the state of printed ghost caused.

The evaluation criteria are as follows.

A: not caused
B: caused to an extremely slight degree
C: caused slightly
D: caused to a not allowable level

TABLE 1

| | Surface protective layer composition (coating liquid composition for forming surface protective layer) | | | | | | | | | | | | | |
|---|---|---|---|---|---|---|---|---|---|---|---|---|---|---|
| | First reactive charge transporting material | | Second reactive charge transporting material | | Guanamine compound OR Melamine compound | | Fluororesin particles | | Alkyl fluoride group-containing copolymer | | Antioxidant | | Curing catalyst | |
| Photo-receptor | Type | Amount (part) | Type | Amount (part) | Type | Amount (part) | Type | Amount (part) | Type | Amount (part) | Type | Amount (part) | Type | Amount (part) |
| Photo-receptor 1 | I-8 | 45 | I-26 | 15 | (A)-17 | 4 | Lubron L-2 | 10 | Structural Formula 2 l:m = 1:1 | 0.3 | Tris-TPM | 1.5 | NACURE 5225 | 0.1 |

TABLE 1-continued

| | Surface protective layer composition (coating liquid composition for forming surface protective layer) | | | | | | | | | | | | | |
|---|---|---|---|---|---|---|---|---|---|---|---|---|---|---|
| | First reactive charge transporting material | | Second reactive charge transporting material | | Guanamine compound OR Melamine compound | | Fluororesin particles | | Alkyl fluoride group-containing copolymer | | Antioxidant | | Curing catalyst | |
| Photo-receptor | Type | Amount (part) | Type | Amount (part) | Type | Amount (part) | Type | Amount (part) | Type | Amount (part) | Type | Amount (part) | Type | Amount (part) |
| Photo-receptor 2 | I-8 | 45 | I-26 | 15 | (A)-17 | 4 | Lubron L-2 | 10 | Structural Formula 2 l:m = 1:1 | 0.3 | Tris-TPM | 1.8 | NACURE 5225 | 0.1 |
| Photo-receptor 3 | I-8 | 45 | I-26 | 15 | (A)-17 | 4 | Lubron L-2 | 10 | Structural Formula 2 l:m = 1:1 | 0.3 | Tris-TPM | 1.2 | NACURE 5225 | 0.1 |
| Photo-receptor 4 | I-8 | 45 | I-26 | 15 | (A)-17 | 4 | Lubron L-2 | 10 | Structural Formula 2 l:m = 1:1 | 0.3 | Tris-TPM | 1.5 | NACURE 5225 | 0.1 |
| Photo-receptor 5 | I-8 | 45 | I-27 | 15 | (A)-17 | 4 | Lubron L-2 | 10 | Structural Formula 2 l:m = 1:1 | 0.3 | Tris-TPM | 1.5 | NACURE 5225 | 0.1 |
| Photo-receptor 6 | I-8 | 45 | I-33 | 15 | (A)-17 | 4 | Lubron L-2 | 10 | Structural Formula 2 l:m = 1:1 | 0.3 | Tris-TPM | 1.5 | NACURE 5225 | 0.1 |
| Photo-receptor 7 | I-21 | 45 | I-26 | 15 | (A)-17 | 4 | Lubron L-2 | 10 | Structural Formula 2 l:m = 1:1 | 0.3 | Tris-TPM | 1.5 | NACURE 5225 | 0.1 |
| Photo-receptor 8 | I-21 | 45 | I-27 | 15 | (A)-17 | 4 | Lubron L-2 | 10 | Structural Formula 2 l:m = 1:1 | 0.3 | Tris-TPM | 1.5 | NACURE 5225 | 0.1 |
| Photo-receptor 9 | I-21 | 45 | I-33 | 15 | (A)-17 | 4 | Lubron L-2 | 10 | Structural Formula 2 l:m = 1:1 | 0.3 | Tris-TPM | 1.5 | NACURE 5225 | 0.1 |
| Photo-receptor 10 | I-8 | 57.1 | I-26 | 2.9 | (A)-17 | 4 | Lubron L-2 | 10 | Structural Formula 2 l:m = 1:1 | 0.3 | Tris-TPM | 1.5 | NACURE 5225 | 0.1 |

TABLE 2

| | Surface protective layer composition (coating liquid composition for forming surface protective layer) | | | | | | | | | | | | | |
|---|---|---|---|---|---|---|---|---|---|---|---|---|---|---|
| | First reactive charge transporting material | | Second reactive charge transporting material | | Guanamine compound OR Melamine compound | | Fluororesin particles | | Alkyl fluoride group-containing copolymer | | Antioxidant | | Curing catalyst | |
| Photo-receptor | Type | Amount (part) | Type | Amount (part) | Type | Amount (part) | Type | Amount (part) | Type | Amount (part) | Type | Amount (part) | Type | Amount (part) |
| Photo-receptor 11 | I-8 | 40 | I-26 | 20 | (A)-17 | 4 | Lubron L-2 | 10 | Structural Formula 2 l:m = 1:1 | 0.3 | Tris-TPM | 1.5 | NACURE 5225 | 0.1 |
| Photo-receptor 12 | I-8 | 45 | I-26 | 15 | (A)-17 | 4 | Lubron L-2 | 10 | Structural Formula 2 l:m = 1:2 | 0.3 | Tris-TPM | 1.5 | NACURE 5225 | 0.1 |
| Photo-receptor 13 | I-8 | 45 | I-26 | 15 | (A)-17 | 4 | Lubron L-2 | 10 | Structural Formula 2 l:m = 1:3 | 0.3 | Tris-TPM | 1.5 | NACURE 5225 | 0.1 |
| Photo-receptor 14 | I-8 | 45 | I-26 | 15 | (A)-17 | 4 | Lubron L-2 | 10 | Structural Formula 2 l:m = 2:1 | 0.3 | Tris-TPM | 1.5 | NACURE 5225 | 0.1 |
| Photo-receptor 15 | I-8 | 45 | I-26 | 15 | (A)-17 | 4 | Lubron L-2 | 10 | Structural Formula 2 l:m = 3:1 | 0.3 | Tris-TPM | 1.5 | NACURE 5225 | 0.1 |
| Photo-receptor 16 | I-8 | 45 | I-26 | 15 | (A)-17 | 4 | Lubron L-2 | 10 | Structural Formula 2 l:m = 1:1 | 0.3 | BHT | 1.5 | NACURE 5225 | 0.1 |

TABLE 3

| | Surface protective layer composition (coating liquid composition for forming surface protective layer) | | | | | | | | | | | | | |
|---|---|---|---|---|---|---|---|---|---|---|---|---|---|---|
| | First reactive charge transporting material | | Second reactive charge transporting material | | Guanamine compound OR Melamine compound | | Fluororesin particles | | Alkyl fluoride group-containing copolymer | | Antioxidant | | Curing catalyst | |
| Photo-receptor | Type | Amount (part) | Type | Amount (part) | Type | Amount (part) | Type | Amount (part) | Type | Amount (part) | Type | Amount (part) | Type | Amount (part) |
| Comparative photo-receptor 1 | I-8 | 45 | I-26 | 15 | (A)-17 | 4 | Lubron 1-2 | 10 | Structural Formula 2 l:m = 1:1 | 0.3 | Tris-TPM | 2.0 | NACURE 5225 | 0.1 |
| Comparative photo-receptor 2 | I-8 | 45 | I-26 | 15 | (A)-17 | 4 | Lubron L-2 | 10 | Structural Formula 2 l:m = 1:1 | 0.3 | Tris-TPM | 1.0 | NACURE 5225 | 0.1 |
| Comparative photo-receptor 3 | I-8 | 58 | I-26 | 2 | (A)-17 | 4 | Lubron L-2 | 10 | Structural Formula 2 l:m = 1:1 | 0.3 | Tris-TPM | 1.5 | NACURE 5225 | 0.1 |
| Comparative photo-receptor 4 | I-8 | 30 | I-26 | 30 | (A)-17 | 4 | Lubron L-2 | 10 | Structural Formula 2 l:m = 1:1 | 0.3 | Tris-TPM | 1.5 | NACURE 5225 | 0.1 |
| Comparative photo-receptor 5 | I-8 | 45 | I-26 | 15 | (A)-17 | 4 | Lubron L-2 | 10 | Structural Formula 2 l:m = 1:1 | 0.3 | BHT | 2.0 | NACURE 5225 | 0.1 |
| Comparative photo-receptor 6 | I-8 | 45 | I-26 | 15 | (A)-17 | 4 | Lubron L-2 | 10 | Structural Formula 2 l:m = 1:1 | 0.3 | BHT | 1.0 | NACURE 5225 | 0.1 |

TABLE 4

| | | Characteristic of surface protective layer | | | | | Evaluation | |
|---|---|---|---|---|---|---|---|---|
| | Photoreceptor type | Relative dielectric constant ∈r | Charge amount Q of carrier traps [C/mm$^2$] | Volume resis-tivity ρ [Ω · m] | Ionization potential IP(OCL) [eV] | IP(OCL) − IP(CTL) [eV] | Evaluation of Black spot-Fogging-White spot | Evalua-tion of printed ghost |
| Example 1 | Photoreceptor 1 | 3.75 | $3.95 \times 10^{-8}$ | $1.72 \times 10^{12}$ | 5.52 | 0.19 | A | A |
| Example 2 | Photoreceptor 2 | 4.0 | $4.0 \times 10^{-8}$ | $1.9 \times 10^{12}$ | 5.54 | 0.21 | B | A |
| Example 3 | Photoreceptor 3 | 3.5 | $4.1 \times 10^{-8}$ | $1.8 \times 10^{12}$ | 5.48 | 0.15 | A | B |
| Example 4 | Photoreceptor 4 | 3.6 | $4.0 \times 10^{-8}$ | $1.8 \times 10^{12}$ | 5.63 | 0.30 | B | B |
| Example 5 | Photoreceptor 5 | 3.68 | $4.02 \times 10^{-8}$ | $1.80 \times 10^{12}$ | 5.53 | 0.20 | B | A |
| Example 6 | Photoreceptor 6 | 3.75 | $3.52 \times 10^{-8}$ | $1.75 \times 10^{12}$ | 5.49 | 0.16 | A | A |
| Example 7 | Photoreceptor 7 | 3.80 | $3.86 \times 10^{-8}$ | $1.84 \times 10^{12}$ | 5.52 | 0.19 | A | A |
| Example 8 | Photoreceptor 8 | 3.79 | $3.81 \times 10^{-8}$ | $1.80 \times 10^{12}$ | 5.49 | 0.16 | A | A |
| Example 9 | Photoreceptor 9 | 3.95 | $3.75 \times 10^{-8}$ | $1.81 \times 10^{12}$ | 5.44 | 0.11 | A | A |
| Example 10 | Photoreceptor 10 | 3.70 | $4.58 \times 10^{-8}$ | $1.92 \times 10^{12}$ | 5.54 | 0.21 | B | A |
| Example 11 | Photoreceptor 11 | 3.82 | $3.69 \times 10^{-8}$ | $1.95 \times 10^{12}$ | 5.49 | 0.16 | A | A |
| Example 12 | Photoreceptor 12 | 3.72 | $3.80 \times 10^{-8}$ | $1.8 \times 10^{12}$ | 5.51 | 0.18 | A | A |
| Example 13 | Photoreceptor 13 | 3.71 | $3.85 \times 10^{-8}$ | $1.75 \times 10^{12}$ | 5.52 | 0.19 | A | A |
| Example 14 | Photoreceptor 14 | 3.68 | $3.91 \times 10^{-8}$ | $1.70 \times 10^{12}$ | 5.55 | 0.22 | A | A |
| Example 15 | Photoreceptor 15 | 3.75 | $3.95 \times 10^{-8}$ | $1.68 \times 10^{12}$ | 5.50 | 0.17 | A | A |
| Example 16 | Photoreceptor 16 | 3.5 | $4.0 \times 10^{-8}$ | $1.8 \times 10^{12}$ | 5.63 | 0.30 | B | B |

TABLE 5

| | | Characteristic of surface protective layer | | | | | Evaluation | |
|---|---|---|---|---|---|---|---|---|
| | Photoreceptor type | Relative dielectric constant ∈r | Charge amount Q of carrier traps [C/mm$^2$] | Volume resis-tivity ρ [Ω · m] | Ionization potential IP(OCL) [eV] | IP(OCL) − IP(CTL) [eV] | Evaluation of Black spot-Fogging-White spot | Evalua-tion of printed ghost |
| Comparative Example 1 | Comparative Photoreceptor 1 | 4.2 | $3.8 \times 10^{-8}$ | $1.9 \times 10^{12}$ | 5.54 | 0.21 | D | D |
| Comparative Example 2 | Comparative Photoreceptor 2 | 3.2 | $3.9 \times 10^{-8}$ | $1.9 \times 10^{12}$ | 5.59 | 0.26 | D | D |
| Comparative Example 3 | Comparative Photoreceptor 3 | 4.3 | $5.32 \times 10^{-8}$ | $2.85 \times 10^{12}$ | 5.48 | 0.15 | D | B |
| Comparative Example 4 | Comparative Photoreceptor 4 | 4.4 | $5.65 \times 10^{-8}$ | $2.55 \times 10^{12}$ | 5.49 | 0.16 | D | B |
| Comparative Example 5 | Comparative Photoreceptor 5 | 4.2 | $3.8 \times 10^{-8}$ | $1.9 \times 10^{12}$ | 5.58 | 0.25 | D | D |
| Comparative Example 6 | Comparative Photoreceptor 6 | 3.2 | $3.9 \times 10^{-8}$ | $1.9 \times 10^{12}$ | 5.59 | 0.26 | D | D |

From the above results, it is understood that all of the evaluations of black spots, fogging, and printed ghost yield superior result in the present examples, compared to comparative examples.

The detailed descriptions for Tables 1 and 2 are as follows

Lubron L-2: ethylene tetrafluoride resin particles ("Lubron L-2" manufactured by DAIKIN INDUSTRIES, ltd.)

NACURE 5225 (manufactured by King Industries, Inc)

Tris-TPM: bis(4-diethylamino-2-methylphenyl)-(4-diethylaminophenyl)-methane

BDETPM: bis(4-diethylamino-2-methylphenyl)-phenylmethane

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor, comprising:

a conductive substrate; and a photosensitive layer provided on the conductive substrate, wherein:

an uppermost surface layer of the electrophotographic photoreceptor is constituted with a cured film of a composition that contains:

at least two reactive charge transporting materials, wherein a first reactive charge transporting material has an —OH group as a reactive functional group and a second reactive charge transporting material has an —$OCH_3$ group as a reactive functional group, fluororesin particles, an alkyl fluoride group-containing copolymer having repeating units represented by the following Structural Formulae A and B, and at least one compound selected from the group consisting of bis(4-diethylamino-2-methylphenyl)-(4-diethylaminophenyl)-methane and bis(4-diethylamino-2-methylphenyl)-phenylmethane, a relative dielectric constant ∈r of the uppermost surface layer satisfies the following Formula (1):

$3.5 \leq \in r \leq 4.0$, and Formula (1):

a charge amount Q of carrier traps of the uppermost surface layer satisfies the following Formula (2):

$Q < 4.0 \times 10^{-8}$ Formula (2):

-continued

Structural Formula A

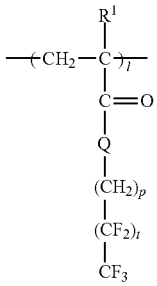

Structural Formula B

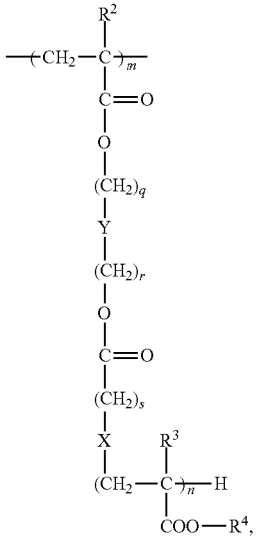

wherein in Structural Formulae A and B, each of $R^1$, $R^2$, $R^3$, and $R^4$ independently represents a hydrogen atom or an alkyl group;

X represents an alkylene chain, a halogen-substituted alkylene chain, —S—, —O—, —NH—, or a single bond;

Y represents an alkylene chain, a halogen-substituted alkylene chain, —($C_zH_{2z-1}$(OH))—, or a single bond;

Q represents —O— or —NH—;

each of l, m, and n independently represents an integer of 1 or greater;

each of p, q, r, and s independently represents 0 or an integer of 1 or greater;

t represents an integer of from 1 to 7; and z represents an integer of 1 or greater.

2. The electrophotographic photoreceptor according to claim 1, wherein the relative dielectric constant ∈r of the uppermost surface layer satisfies the following Formula (1-2):

$3.6 \leq \in r \leq 4.0$. Formula (1-2):

3. The electrophotographic photoreceptor according to claim 1, wherein the relative dielectric constant ∈r of the uppermost surface layer satisfies the following Formula (1-3):

$3.6 \leq \in r \leq 3.9$. Formula (1-3):

4. The electrophotographic photoreceptor according to claim 1, wherein a ratio between a weight of the first reactive charge transporting material and a weight of the second reactive charge transporting material is from about 2 to about 20.

5. The electrophotographic photoreceptor according to claim 1, wherein the photosensitive layer includes a charge generating layer and a charge transporting layer in this order, the uppermost surface layer is provided on the charge transporting layer, and a difference between an ionization potential IP(OCL) of the uppermost surface layer and an ionization potential IP(CTL) of the charge transporting layer satisfies Formula (4):

$$IP(OCL)-IP(CTL)\leq 1.0. \quad \text{Formula (4):}$$

6. The electrophotographic photoreceptor according to claim 1, wherein the photosensitive layer includes the charge generating layer and the charge transporting layer in this order, the uppermost surface layer is provided on the charge transporting layer, and a difference between the ionization potential IP(OCL) of the uppermost surface layer and the ionization potential IP(CTL) of the charge transporting layer satisfies Formula (4-2):

$$IP(OCL)-IP(CTL)\leq 0.5. \quad \text{Formula (4-2):}$$

7. The electrophotographic photoreceptor according to claim 1, wherein the photosensitive layer includes the charge generating layer and the charge transporting layer in this order, the uppermost surface layer is provided on the charge transporting layer, and a difference between the ionization potential IP(OCL) of the uppermost surface layer and the ionization potential IP(CTL) of the charge transporting layer satisfies Formula (4-3):

$$IP(OCL)-IP(CTL)\leq 0.2. \quad \text{Formula (4-3):}$$

8. The electrophotographic photoreceptor according to claim 1, wherein the at least two reactive charge transporting materials are compounds represented by Formula (I):

$$F—((—R^{13}—X)_{n1}(R^{14})_{n2}—Y)_{n3} \quad (I)$$

wherein in Formula (I),

F represents a charge transporting skeleton and is an organic group derived from a compound with an ability to transport charge;

each of $R^{13}$ and $R^{14}$ independently represents a linear or branched alkylene group having from 1 to 5 carbon atoms;

n1 represents 0 or 1;

n2 represents 0 or 1;

n3 represents an integer of from 1 to 4;

X represents oxygen, NH, or a sulfur atom; and

Y represents an —OH group in the first reactive charge transporting material, and an —$OCH_3$ group in the second reactive charge transporting material.

9. The electrophotographic photoreceptor according to claim 8, wherein the at least two reactive charge transporting materials are compounds represented by Formula (II):

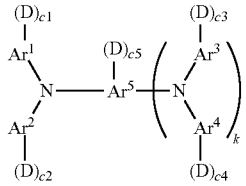

(II)

wherein in Formula (II), $Ar^1$ to $Ar^4$ may be the same as or different from each other;

each of $Ar^1$ to $Ar^4$ independently represents a substituted or unsubstituted aryl group;

$Ar^5$ represents a substituted or unsubstituted aryl group or a substituted or unsubstituted arylene group;

D represents $—(—R^{13}—X)_{n1}(R^{14})_{n2}—Y$;

each of c1 to c5 independently represents 0 or 1;

k represents 0 or 1;

a total number of D is from 1 to 4;

each of $R^{13}$ and $R^{14}$ independently represents a linear or branched alkylene group having from 1 to 5 carbon atoms;

n1 represents 0 or 1;

n2 represents 0 or 1;

X represents oxygen, NH, or a sulfur atom; and

Y represents an —OH group in the first reactive charge transporting material, and an —$OCH_3$ group in the second reactive charge transporting material.

10. An electrophotographic photoreceptor, comprising:

a conductive substrate; and a photosensitive layer provided on the conductive substrate, wherein:

an uppermost surface layer of the electrophotographic photoreceptor is constituted with a cured film of a composition that contains:

at least two reactive charge transporting materials, wherein a first reactive charge transporting material has an —OH group as a reactive functional group and a second reactive charge transporting material has an —$OCH_3$ group as a reactive functional group, fluororesin particles, an alkyl fluoride group-containing copolymer having repeating units represented by the following Structural Formulae A and B, and at least one compound selected from the group consisting of bis(4-diethylamino-2-methylphenyl)-(4-diethylaminophenyl)-methane and bis(4-diethylamino-2-methylphenyl)-phenylmethane, and a relative dielectric constant ∈r of the uppermost surface layer satisfies the following Formula (1):

Formula (1): $3.5 \leq \varepsilon r \leq 4.0$,

Structural Formula A

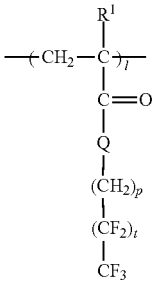

Structural Formula B

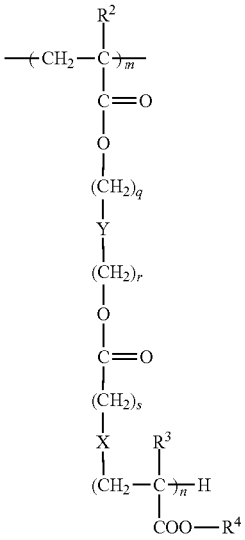

wherein in Structural Formulae A and B, each of $R^1$, $R^2$, $R^3$, and $R^4$ independently represents a hydrogen atom or an alkyl group;

X represents an alkylene chain, a halogen-substituted alkylene chain, —S—, —O—, —NH—, or a single bond;

Y represents an alkylene chain, a halogen-substituted alkylene chain, —($C_zH_{2z-1}$(OH))—, or a single bond;

Q represents —O— or —NH—;

each of l, m, and n independently represents an integer of 1 or greater;

each of p, q, r, and s independently represents 0 or an integer of 1 or greater;

t represents an integer of from 1 to 7; and z represents an integer of 1 or greater.

11. A process cartridge detachable from an image forming apparatus, comprising the electrophotographic photoreceptor according to claim 1.

12. An image forming apparatus comprising:

the electrophotographic photoreceptor according to claim 1;

a charging unit that charges the electrophotographic photoreceptor;

an electrostatic latent image forming unit that forms an electrostatic latent image on the charged electrophotographic photoreceptor;

a developing unit that accommodates a developer containing a toner and develops the electrostatic latent image formed on the electrophotographic photoreceptor into a toner image by using the developer; and a transfer unit that transfers the toner image to a transfer medium.

* * * * *